US010589327B2

(12) United States Patent
Stewart et al.

(10) Patent No.: US 10,589,327 B2
(45) Date of Patent: Mar. 17, 2020

(54) APPARATUS AND METHOD FOR ROLLING METAL

(71) Applicants: Patricia Stewart, Pittsburgh, PA (US); Neville C. Whittle, Irwin, PA (US); Dharma Maddala, Monroeville, PA (US); Shawn Clark, Lower Burrell, PA (US); Thomas Kasun, Export, PA (US); Julie Wise, Natrona Heights, PA (US); Ming Li, Murrysville, PA (US); Raymond J. Kilmer, Pittsburgh, PA (US)

(72) Inventors: Patricia Stewart, Pittsburgh, PA (US); Neville C. Whittle, Irwin, PA (US); Dharma Maddala, Monroeville, PA (US); Shawn Clark, Lower Burrell, PA (US); Thomas Kasun, Export, PA (US); Julie Wise, Natrona Heights, PA (US); Ming Li, Murrysville, PA (US); Raymond J. Kilmer, Pittsburgh, PA (US)

(73) Assignee: ARCONIC INC., Pittsburgh, PA (US)

( * ) Notice: Subject to any disclaimer, the term of this patent is extended or adjusted under 35 U.S.C. 154(b) by 500 days.

(21) Appl. No.: 14/708,894

(22) Filed: May 11, 2015

(65) Prior Publication Data

US 2015/0321232 A1 Nov. 12, 2015

Related U.S. Application Data

(60) Provisional application No. 61/991,973, filed on May 12, 2014.

(51) Int. Cl.
*B21B 1/46* (2006.01)
*B21B 27/00* (2006.01)
(Continued)

(52) U.S. Cl.
CPC ..... *B21B 27/005* (2013.01); *B21B 1/227* (2013.01); *B21B 1/46* (2013.01); *B21B 45/004* (2013.01);
(Continued)

(58) Field of Classification Search
CPC ..... B21B 2001/221; B21B 2001/225; B21B 1/227; B21B 2003/001; B21B 27/005;
(Continued)

(56) References Cited

U.S. PATENT DOCUMENTS 3,619,881 A * 11/1971 Bills et al. ..... B21B 1/227 492/1
4,658,882 A 4/1987 Oba et al.
(Continued)

FOREIGN PATENT DOCUMENTS

EP 1980345 5/2013
JP 05228516 A 8/2009
(Continued)

OTHER PUBLICATIONS

The Manufacture of Hot-Strip Mill Products, p. 1069 from "The Making, Shaping and Treating of Steel", 10th Edition, 1985.*
(Continued)

*Primary Examiner* — Edward T Tolan
(74) *Attorney, Agent, or Firm* — Greenberg Traurig, LLP

(57) ABSTRACT

An apparatus and method for rolling aluminum sheet uses a texture roll to roll the sheet while is it hot and has reduced yield strength. The texture rolling may be used to remediate defects in the sheet at a variety of stages in rolling, and may facilitate subsequent rolling stages.

30 Claims, 16 Drawing Sheets

(51) Int. Cl.

| | |
|---|---|
| ***B21B 45/00*** | (2006.01) |
| ***B21B 45/02*** | (2006.01) |
| ***B21B 1/22*** | (2006.01) |
| *B21B 3/00* | (2006.01) |
| *B21B 37/74* | (2006.01) |

(52) U.S. Cl.
CPC ..... *B21B 45/0215* (2013.01); *B21B 45/0239* (2013.01); *B21B 37/74* (2013.01); *B21B 2003/001* (2013.01); *B21B 2265/14* (2013.01); *B21B 2267/10* (2013.01); *Y10T 29/49828* (2015.01)

(58) Field of Classification Search
CPC ..... B21B 2261/14; B21B 2261/20; B21B 2267/10; B21B 28/02; B21B 1/22; B21B 1/46
See application file for complete search history.

(56) References Cited

U.S. PATENT DOCUMENTS

| | | | | |
|---|---|---|---|---|
| 4,789,447 | A * | 12/1988 | Ahmed | B23H 7/18 204/224 M |
| 5,508,119 | A * | 4/1996 | Sheu | B21B 1/227 219/121.67 |
| 5,789,066 | A | 8/1998 | De Mare et al. | |
| 6,187,455 | B1 * | 2/2001 | Eschauzier | B21B 1/227 160/113 |
| 6,672,368 | B2 | 1/2004 | Unal | |
| 7,516,637 | B2 | 4/2009 | Scamans et al. | |
| 9,256,129 | B2 * | 2/2016 | Gotsick | G03F 7/168 |
| 2003/0084972 | A1 | 5/2003 | Matsubara et al. | |
| 2005/0211350 | A1 | 9/2005 | Unal et al. | |
| 2010/0127125 | A1 * | 5/2010 | Li | B21B 1/227 244/119 |
| 2010/0242559 | A1 * | 9/2010 | Saenz de Miera | B21B 1/38 72/207 |
| 2012/0064293 | A1 * | 3/2012 | Siemen | B05D 1/265 428/141 |
| 2013/0122327 | A1 | 5/2013 | Sheu et al. | |
| 2013/0273394 | A1 * | 10/2013 | Sheu | B21B 1/227 428/687 |
| 2015/0209848 | A1 * | 7/2015 | Kopplin | B21B 1/227 428/659 |

FOREIGN PATENT DOCUMENTS

| | | |
|---|---|---|
| WO | 2007/076980 | 7/2007 |
| WO | 2010/017289 A1 | 2/2010 |
| WO | 2013/172912 | 11/2013 |

OTHER PUBLICATIONS

Haga, T. et al., High speed twin roll casting of 6016 strip, Journal of Achievements in Materials and Manufacturing Engineering, (Sep. 2006), p. 373.

International Search Report and Written Opinion of the International Searching Authority dated Jul. 28, 2015 in reference to International Application No. PCT/US15/30143.

Extended European Search Report dated Jan. 1, 2018, issued by the European Patent Office in European Patent Application No. 15792751.8.

* cited by examiner

Large Scratches
~1000 μm by ~200μm

Sliver Example on Surface 1312A
1312AD
5%
1312AB
1312AO
1312BD
10%
1312B
1312BB
1312BO
1312C
1312CD
20%
1312CB
1312O
1312AB
1312AT
1312AD
H-Link 572
1312BT
1312BB
1312BD
H-Link ***
1312CD
1312CB
1312CT
1312CB
1312CP
[µm]
[mm]
Height [µm]
Position [nm]
1312AB
1312AD
1312AP
1312BD
1312BB
1312BP
1312CD 10% Reduction 25% Reduction 10% Reduction 25% Reduction Mill Finish Surface EDT Textured Surface

APPARATUS AND METHOD FOR ROLLING METAL

CROSS REFERENCE TO RELATED APPLICATIONS

This application claims the benefit of U.S. Provisional Application No. 61/991,973, filed May 12, 2014, entitled Apparatus and Method For Rolling Aluminum, which is incorporated by reference herein in its entirety for all purposes.

FIELD

The present invention relates to manufacturing sheet material, and more particularly, to methods and apparatus for rolling metal, such as aluminum and aluminum alloys into sheet and for producing sheet material with desired surface and subsurface properties.

BACKGROUND

Various methods for rolling aluminum and for providing the resultant rolled sheet with a given surface texture are known. A surface texture may be imparted to a sheet surface by a roll which has a surface textured by processes such as Electrical Discharge Texturing (EDT), roll grinding, cross hatch-grinding, ball or shot peening, etc. As used in the art, a "texture roll" would typically be defined as: a roll with a random or repeated pattern, isotropic or directional pattern of surface peaks and valleys with defined average heights and spacing for either aesthetic or functional purposes. The texture of the textured roll may be imparted to aluminum, steel and other metal surfaces, normally in a range of low reduction (3 to 10%) in a post cold rolling operation. For automotive sheet with an EDT texture, this is typically carried out as the last pass on a skin pass (temper) mill. The application of texture after cold rolling in a skin pass or a cold mill often results in limited transfer of the roll surface texture to the sheet due to the cold worked properties of the product, the size of the rolls and the low reductions employed. This may lead to the incoming surface not being totally eliminated or masked by the texture on the roll surface. This is particularly undesirable when features such as scratches or metal slivers from upstream processes are present. A sliver is defined as "A thin, elongated fragment of metal that has been rolled onto the surface of the parent metal and is attached by only one end." (McGraw-Hill *Dictionary Of Scientific And Technical Terms*, Third Edition, p. 1491). Alternatively a sliver may be defined as a "Thin fragment of aluminum which is part of the material but only partially attached." (*Visual Quality Attributes of Aluminum Sheet and Plate*, Al Assoc., 1994). Higher reductions with EDT rolls in cold rolling may also lead to more debris generation and diminishing the cleanliness of the sheet produced as a final product or as an intermediate product that is subjected to further processing.

In addition, a post cold rolling skin pass adds another step in the process which adds cost to the product. Improved and/or alternative methods and apparatus for imparting a desired surface texture to an aluminum sheet therefore remain desirable.

SUMMARY

The disclosed subject matter relates to a method for rolling a sheet of metal provided at a first state to achieve a second state, including rolling the metal sheet with a texture roll when the metal sheet is at a temperature at which the metal sheet exhibits reduced yield strength relative to a yield strength of the metal sheet at ambient temperature.

In another aspect of the disclosure, the metal is aluminum and the temperature at which the metal sheet is rolled by the texture roll is between 250 to 970 degrees Fahrenheit. In another aspect, the texture roll exhibits a surface roughness in the range of 1 micrometer to 50 micrometers.

In another aspect, the step of rolling results in a reduction in thickness of the metal sheet in a range of 0% to 30%.

In another aspect, the reduction in thickness is in a range of 0% to 70%.

In another aspect, the step of rolling results in a transfer of texture to between 60% to 100% of the surface of the metal sheet.

In another aspect, the step of rolling with a texture roll is a first rolling step and further including a second rolling step conducted on the metal sheet subsequent to the first rolling step.

In another aspect, the second step is a second texture rolling step.

In another aspect, the first rolling step is conducted with a texture roll having a courser texture than a texture roll used for the second rolling step.

In another aspect, the first and second rolling steps decrease a grain size of the metal sheet.

In another aspect, the second rolling step is by cold reduction rolling.

In another aspect, the second rolling step is by hot reduction rolling.

In another aspect, the first rolling step creates surface features in the metal sheet that are capable of receiving lubricant therein.

In another aspect, further including multiple rolling steps, the first step of rolling with a texture roll reducing the number of rolling steps that would otherwise be required to achieve a final target state for the metal sheet.

In another aspect, the first step of rolling facilitates the second step of rolling.

In another aspect, the first step of rolling remediates defects present in the metal sheet that would not otherwise be remediated by the second step of rolling.

In another aspect, the step of rolling when the metal sheet exhibits reduced yield strength reduces texture roll wear that would otherwise occur if rolling were conducted at a lower temperature.

In another aspect, a reduction in texture roll wear corresponds to extended texture roll life.

In another aspect, the first step of rolling reduces transfer of the metal sheet during the second step of rolling.

In another aspect, the step of rolling when the metal sheet exhibits reduced yield strength obliterates surface defects present in the metal sheet.

In another aspect, the step of rolling when the metal sheet exhibits reduced yield strength reduces sub-surface defects present in the metal sheet.

In another aspect, the step of rolling when the metal sheet exhibits reduced yield strength redistributes metal in the metal sheet through deformation.

In another aspect, the step of rolling when the metal sheet exhibits reduced yield strength is conducted as a final rolling step prior to winding the metal sheet into a coil.

In another aspect, the surface defects obliterated by the step of rolling are in a range of from 10 μm to 1 mm.

In another aspect, the step of rolling is accompanied by at least one of once-through lubrication, evaporative roll cooling, roll surface coating or high-pressure water blasting.

In another aspect, the temperature of the metal sheet is attributable to residual heat present in the metal sheet persisting from a prior state of processing.

In another aspect, the temperature of the metal sheet is attributable to heat conferred to the metal sheet by a source of heat.

In another aspect, a texture of the texture roll is conferred to the texture roll by at least one of EDT, ball peening, shot peening, grinding or cross hatch-grinding.

In another aspect, a texture of the texture roll has a discernable pattern.

In another aspect, a texture of the texture roll has no discernable pattern.

In another aspect, further comprising the step of forming the metal sheet into an automotive panel after the step of rolling.

In another aspect, the automotive panel is a closure panel.

In another aspect, the step of forming produces a plurality of closure panels and further comprising the step of joining a plurality of closure panels.

In another aspect, further including incorporating the automotive panel in a body-in-white.

In another aspect, the sheet is provided in the first state by a Micromill™.

In another aspect, the step of rolling with the texture roll obscures surface defects in the sheet that are perceptible to the human eye.

In another aspect, the defects are on a scale of 10 μm to 200 μm.

In another aspect, the texture of the texture roll in the range of 600 μin to 1200 μin and the reduction is in the range of 5% to 25%.

In another aspect, the defects are completely obscured to the human eye.

In another aspect, the defects are at least one of scratches or slivers.

In another aspect, the defects form a discernable pattern.

In another aspect, the pattern is a repeating pattern.

In another aspect, the defects are obscured by reducing the average peak to valley distance.

In another aspect, the defects are obscured by rendering the area of the defect closer in roughness Ra to the background surface proximate the defect.

In another aspect, the sheet after rolling with the texture roll exhibits a uniform isotropic texture as discernible by human vision at a range of 0.1 to 5 feet.

In another aspect, a rolling mill for rolling metal and producing a sheet of metal, has a texture roll positioned in the rolling mill at a position where the metal sheet is at a temperature at which the metal sheet exhibits reduced yield strength relative to a yield strength of the metal sheet at ambient temperature.

In another aspect, the rolling mill has a heating device, the heating device heating the metal prior to the texture roll.

In another aspect, the rolling mill has a casting mill, the output of which is a metal casting that is rolled by the rolling mill.

In another aspect, the casting mill is a Micromill™.

In another aspect, the temperature at which the metal sheet exhibits reduced yield strength is in the range of about 250 to 970 degrees Fahrenheit.

In another aspect, the texture roll exhibits a surface roughness Ra in the range of 1 micrometer to 50 micrometers.

In another aspect, the reduction at the texture roll is in the range of 0% to 70%.

In another aspect, the rolling mill has additional rolling stations after the texture roll.

In another aspect, the additional rolling stations include texture rolling stations.

In another aspect, the additional texture rolling stations have a surface texture finer than the texture roll.

BRIEF DESCRIPTION OF THE DRAWINGS

For a more complete understanding of the present disclosure, reference is made to the following detailed description of exemplary embodiments considered in conjunction with the accompanying drawings.

DETAILED DESCRIPTION OF EXEMPLARY EMBODIMENTS

Aspects of the present disclosure include the recognition that surface texturing can be conducted when the sheet to be textured is hot, e.g., between, 250-970° F. to reduce roll pressure and increase transfer; that texturing can be utilized to repair or improve surface and sub-surface damage existing on a sheet or caused by an upstream process (e.g., fissures, scratches, slivers and dents that would not be beneficially impacted by conventional cold texturing), resulting in improved surface quality by eliminating incoming surface features or patterns from a casting or rolling process; that texturing can be applied as an intermediate step in rolling, which is followed by subsequent rolling passes in subsequent stages and which enhances and facilitates the subsequent steps in the rolling process, such as reduction rolling by either hot or cool rolls; that a "rough" texture imparted by a texture roll having a "rough" surface may be useful in repairing surface defects, preparing the sheet for further processing and producing a sheet having beneficial properties; and that texturing can be conducted simultaneously with reductions if conducted at elevated temperatures. This surface texturing may be conducted over a range of reductions and may eliminate or mask features such as scratches or slivers with little/no adverse effect on surface cleanliness. These and other aspects of the present disclosure shall be described further below.

Figure 1:
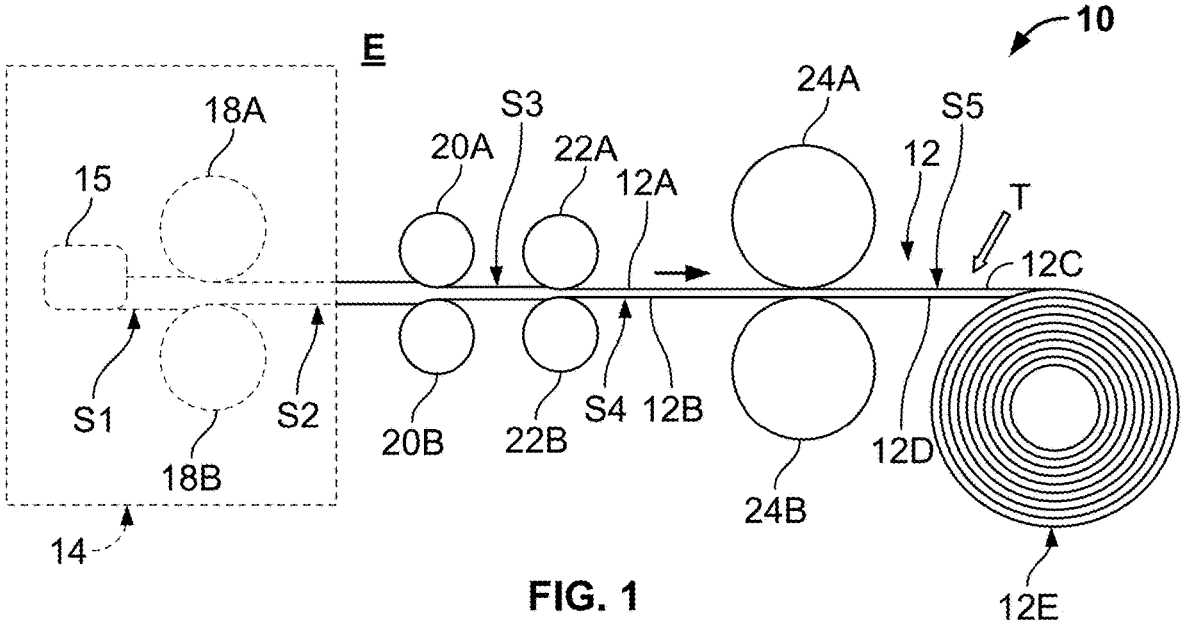
FIG. 1 is a diagrammatic view of an apparatus and method for producing sheet material in accordance with an embodiment of the present disclosure.

FIG. 1 shows an apparatus 10 for producing sheet material 12, such as aluminum sheet. The apparatus 10 may include an upstream source 14 of aluminum metal that is ultimately formed into the sheet 12. A variety of sources 14 may be utilized with the apparatus and process of the present disclosure and the source is enclosed in a dotted rectangle to express this variability. For example, source 14, may include an outlet 15, e.g., of a pusher furnace that pushes a hot slab ingot, a nozzle outlet of a cast box, an outlet of a coil unwinder, the outlet of a roll or slab caster, or the outlet of a micro mill, such as a micro mill and process described in U.S. Pat. No. 6,672,368, owned by Alcoa, Inc. for continuously casting and rolling aluminum sheet 12 from a reservoir of molten aluminum. In one embodiment, the apparatus 10 may be a hot coiling mill that is modified in accordance with the present disclosure to apply a texture in-line. The aluminum sheet 12 at state S1 may exhibit a given temperature, e.g., 950 to 1100° F., state of solidification/hardness, temper, dimensionality, surface texture, surface integrity and subsurface structure. Optionally, e.g., in the case of an outlet 15 of a micro mill, the aluminum sheet 12 may be passed through one or more sets of rolling mill rolls 18A, 18B that reduce the thickness of the aluminum sheet 12. As a result, the sheet 12 assumes a second state S2 having a given temperature, state of solidification, hardness, temper, dimensionality, surface texture, surface integrity and subsurface structure. As the aluminum sheet 12 extends from the source 14, it is exposed to the ambient environment E, which may cool or heat the aluminum sheet 12. As the aluminum sheet 12 progresses through the apparatus 10, it assumes different states S1, S2 . . . S5, e.g., with respect to temperature and related states, such as hardness/yield strength/plasticity. In addition to the gradual changes in state associated with temperature change, the aluminum sheet 12 may undergo changes in dimensionality as it proceeds thorough a given apparatus 10. For example, the aluminum sheet 12 at state S2 may optionally be reduced in thickness by rolls 20A, 20B producing a state S3 and again by rolls 22A, 22B producing state S4. In accordance with an aspect of the present disclosure, the aluminum sheet 12 may then be surfaced/textured by texturing rolls 24A, 24B, when the sheet 12 is at an elevated temperature, e.g., 250-970° F. This particular temperature range for the sheet 12 may be achieved due to the residual heat energy retained by the sheet 12, e.g., due to casting, or the sheet 12 may be heated prior to being textured by texturing rolls 24A, 24B. The texturing rolls 24A, 24B may have been previously surfaced by electrical discharge texturing (EDT), by ball or shot peening, grinding, cross-grinding or another method to achieve a desired texture to impart to the sheet 12. Textured rolls may exhibit a random set of peaks and valleys such as those produced with EDT, abrasive blasting, laser beam texturing, electron beam texturing with peak to valley heights ranging from 0.5 μm to 50 μm Ra or more as desired for the incoming surface features to be affected. These features generally do not have a preferred direction based on the process used. Textured rolls may also exhibit preferred directions in that they are oriented or have deterministic set of characteristics produced by the process used such as grinding, belt grinding, laser or electron beam texturing. The size and orientation of these features may be designed and controlled by these processes such as to create surfaces with peak to valley heights 0.1 μm to 25 μm Ra measured in a transverse direction. Grinding may produce topographies in the longitudinal direction with features from 0.5 mm to many cms long at angles from 1 degree to 45 degrees or more dependent on abrasive to part rotation/traverse speed ratios.

If texturing by rolls 24A, 24B is conducted at high temperature, e.g., 250-970° F., the high temperature lowers the yield strength and enables higher topography transfer at lower roll force levels at low reduction levels compared to texturing at room temperature. An aspect of the present disclosure is the recognition that texturing the sheet 12 at high temperatures at low roll force levels and at low reductions can be used to repair surface and sub-surface defects present in the sheet prior to texturing, e.g., defects such as slivers that may be caused by adhesive metal transfer to rolls at stations prior to the texturing rolls 24A, 24B, e.g., at rolls 20A, 20B and/or 22A, 22B. In conducting high temperature texture rolling, the temperature range of 250-970° F. of the sheet 12 may be exhibited by an outer layer, i.e., the sheet may exhibit a temperature gradient from the outside to the inside, such that more interior portions are either hotter or cooler than the outer portions. Since the temperature of the sheet may vary with time and can be adjusted by heating or cooling the sheet 12, the temperature may be measured and controlled to achieve a selected temperature range for the outer portion of the sheet 12 just prior to texturing with texturing rolls 24A, 24B suitable for a given texture that is applied.

The texturing rolls 24A, 24B may be driven by frictional interaction with the sheet 12, which may be pulled through by a coil winder (not shown) which rotates coiled sheet 12E. This sheet driving arrangement may be used to reduce forward sliding, i.e., sliding of the sheet 12 over the surface of the texture rolls 24A, 24B or other non-synchronized motion of the sheet relative to the rolls 24A, 24B, which may adversely effect the surface of the sheet 12. Because texturing is conducted at higher temperatures, the texture on the texturing rolls 24A, 24B may be more readily imparted to the sheet 12 with reduced roll pressure than if texturing were conducted at conventional, cooler temperatures.

In one example, the texturing rolls 24A, 24B may have a surface roughness Ra of about 1 to 10 μm. If the aluminum sheet 12 at state S4 has a temperature of 250° F. to 970° F., the texturing rolls 24A, 24B may be pressed against the sheet 12 producing a reduction in thickness of about 1 to 30% or higher, as required, and transferring the surface texture of the texturing rolls 24A, 24B to about 60 to 100% of the surfaces 12C, 12D of the sheet 12 in state S5. Since the aluminum sheet 12 in state S4 is more malleable and accepts the impression of the texturing rolls 24A, 24B more readily than sheet aluminum that has been allowed to cool and temper, the texturing may be conducted with less pressure, to a greater extent, with greater fidelity to the surface texture of the texturing rolls 24A, 24B and with less wear of the rolls 24A, 24B and less debris generation. The synchronous texturing (rate of rotation of texture rolls 24A, 24B relative to sheet throughput rate) produces improved texture transfer leading to a more consistent sheet 12 surface with fewer blemishes. The reduction in roll pressure associated with hot texture rolling can lead to less wear of the texture rolls 24A, 24B, implying fewer roll changes would be required to process a given amount of sheet 12.

An aspect of the present disclosure is the recognition that surfacing of the aluminum sheet 12 at high temperatures may be accomplished by subjecting the aluminum sheet 12 to texturing rolls 24A, 24B rolls that have been surfaced by electrical discharge texturing (EDT). Alternatively, rolls 24A, 24B may be textured by ball or shot peening, plating, polishing or other surface treatments, may be used to surface the sheet 12 when the aluminum sheet 12 is at an elevated temperature of, e.g., from 250 to 970° F. At the foregoing temperature range, the aluminum sheet 12 is softer, having a lower yield strength of e.g., <10 ksi untempered, and more readily formed by the action of the texturing/surfacing rolls. In addition, if the aluminum sheet 12 is surfaced before cold working, e.g., in a cold rolling mill, the surfacing can be accomplished more easily, in that the aluminum sheet 12 has not been mechanically tempered/hardened by cold working. The foregoing benefits can be realized by incorporating the texturing rolls 24A, 24B into a line of a mill, e.g., a hot coiling mill, that produces aluminum sheet 12 from a melt, thereby utilizing the heat inherently present in the aluminum sheet 12 by virtue of its production by the mill and applying the surfacing treatment while the aluminum sheet 12 is still hot and prior to coiling. In this manner, the aluminum sheet may be produced efficiently, minimizing or eliminating subsequent surfacing/rolling treatments before and/or after coiling. As described below, in an alternative embodiment, cooled sheet 12 may be heated prior to surfacing by texture rolls.

It should be appreciated that each of the rolls 18A, 18B, 20A, 20B, 22A, 22B, 24A, 24B and the environment E may be temperature controlled, e.g., by insulation provided by an enclosing structure, e.g., a tunnel, and/or by heating, e.g., by natural gas combustion or electrical resistance or induction heating. The temperature of the aluminum sheet 12 at the time of texturing/surfacing may be controlled by preserving heat energy present in the aluminum sheet 12 due to casting and/or by imparting heat energy to the sheet 12 via exposure to heated media, e.g., air in the environment, radiation, flame, or through contact with a heated surface, e.g., rolls 20A, 20B, 22A, 22B, casting rolls 18A, 18B and/or the texturing rolls 24A, 24B.

After the surfacing of the aluminum sheet 12 by the texturing rolls 24A, 24B, to achieve state S5, the aluminum sheet 12 may be exposed to radiation and/or media, e.g., air or water at temperature T for heat treating, cooling, hardening and/or tempering. For example, the sheet 12 may be exposed to the environment E, or may be actively cooled or heated, e.g., by a water quench at a selected temperature, via passage through a bath or spray station, a heated tunnel or exposed to cool or warm air via a blower, etc. An aspect of the present disclosure is the recognition that the surfacing of the aluminum sheet 12 may be conducted prior to cooling, final heat treatment, tempering and/or hardening After undergoing the desired treatment, if any, the aluminum sheet 12 may then be coiled into a coiled condition 12E for storage and transport via conventional methods.

The approach of the present disclosure of texturing at high temperatures enables imparting a "rougher" (e.g., 50 μm Ra surface topography) compared to room temperature conventional temper/skin pass processing. (In this field, the units micrometer (μm) and microinch (μin) are commonly and interchangeably used, with 1 μm=39.37 μin. For example, in the United States, a texturing roll might be described, e.g., as a 600 or 1200 EDT roll, which would mean that it has an average surface roughness of 600 or 1200 μin Ra, which is equivalent to an EDT roll with an average surface roughness of 15.20 μm or 30.48 μm Ra, respectively.) The high temperatures lower the yield strength and enable higher topography transfer at lower roll force and low reductions. Typically, "rough" surface topography, high reductions and high temperatures promote adhesive metal transfer and thus subsurface damage to the sheet. The approach of the present disclosure significantly reduces adhesive metal transfer and subsurface damage by rolling at low loads, at low reduction and with little or no forward sliding. In accordance with the approach of the present disclosure, a texture may be applied to a sheet 12 forming numerous depressions on the sheet surface. These depressions imparted to the sheet 12 by high temperature texture rolling may be beneficial in accommodating lubricant therein that eases rolling and may translate in some instances in the ability to eliminate a cold rolling pass. Another aspect of the present disclosure is that it permits the rolling of sheet that has an isotropic matte finish with fewer blemishes. In the instance of rolling rougher textures on the sheet 12, this roughness Ra may translate into higher wrap-to-wrap friction, which lessens the likelihood of coil collapse. Texturing in accordance with the present disclosure may be conducted at a depth that disturbs the subsurface of the sheet, leading to a better finish on the sheet 12 end product. More particularly, sheet 12 from a given source can be analyzed to ascertain the scale and distribution of typical surface and sub-surface defects. A texture having a surface roughness Ra of the appropriate scale can then be selected and applied to texturing rolls 24A, 24B, such that the depth and resolution (spacing) of the impressions made by the texturing rolls 24A, 24B will obliterate the surface and sub-surface defects present in the sheet, e.g., by material redistribution when in a softened state during high temperature texturing. In another aspect of the present disclosure, the EDT roll texture eliminates non uniform surfaces coming into a rolling operation creating an isotropic surface signature measureable with optical or topography measurement systems such as an Optimap™ from Rhopoint Instruments, a Scatterscope from the Scatterworks or 3D interferometry or confocal microscopy. In another aspect, the surface signature is traceable through the textured and standard rolling processes and may be highlighted by surface coatings or treatments.

An aspect of the present disclosure is the recognition that in passing through each successive stage in the apparatus 10, the amenability to change state and the resultant changes wrought in the sheet 12 are dependent upon the prior state, in particular, the state with respect to surface texture and integrity and subsurface structure. A gradual change of state through successive stages of rolling, texturing or other treatments, with each stage working the sheet 12 in a manner appropriate in scale and pattern in light of the prior and/or subsequent worked state can be described as controlled surface evolution.

For the best replication of the original roll surface texture onto the sheet surface, it is critical to prevent metal build-up on the roll surface textures. The approach of the present disclosure may be enhanced/enabled by once-through lubrication, evaporative roll cooling, use of roll surface coatings and high pressure water blasting or similar roll cleaning. These measures address the need to keep the rolls clean and at the desired temperature, as well as to control friction (by sheet lubrication) while preserving surface quality.

Figure 2:
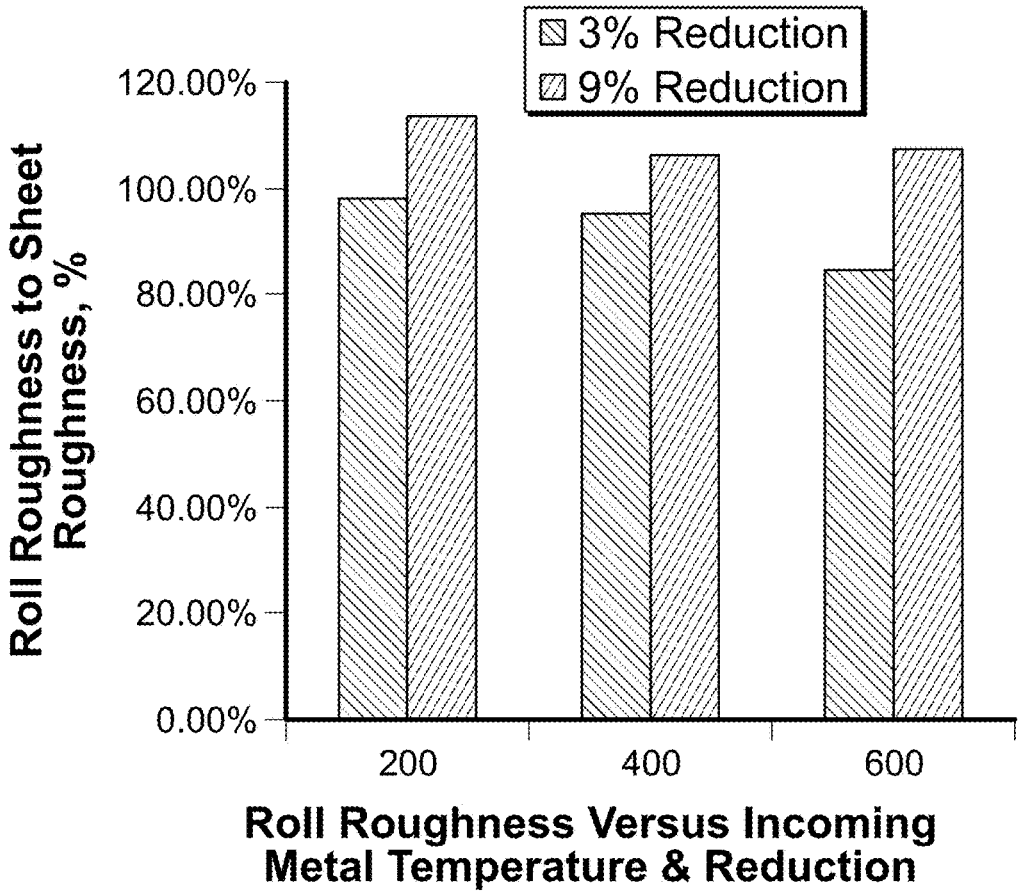
FIG. 2 is a graph showing roll roughness to sheet roughness transfer expressed as a percentage for 3% and 9% rolling reductions taken at 200, 400 and 600° F.

FIG. 2 is a graph showing roll roughness to sheet roughness transfer expressed as a percentage for 3% and 9% rolling reductions taken at 200, 400 and 600° F. High percentage topography transfers at low reductions and mill loads are enabled by the methods and apparatus of the present disclosure. By comparison, transfer for cold rolling EDT may be significantly less, e.g., 60%.

Figure 3A:
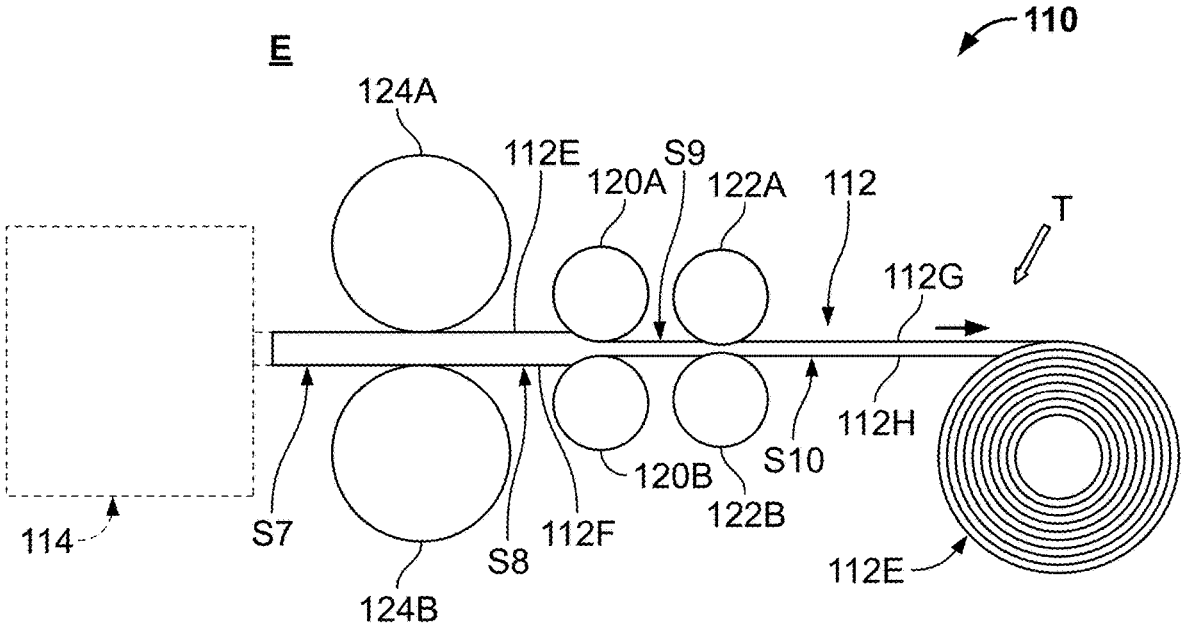
FIG. 3A is a diagrammatic view of an apparatus and method for producing sheet material in accordance with an embodiment of the present disclosure.
Figure 3B:
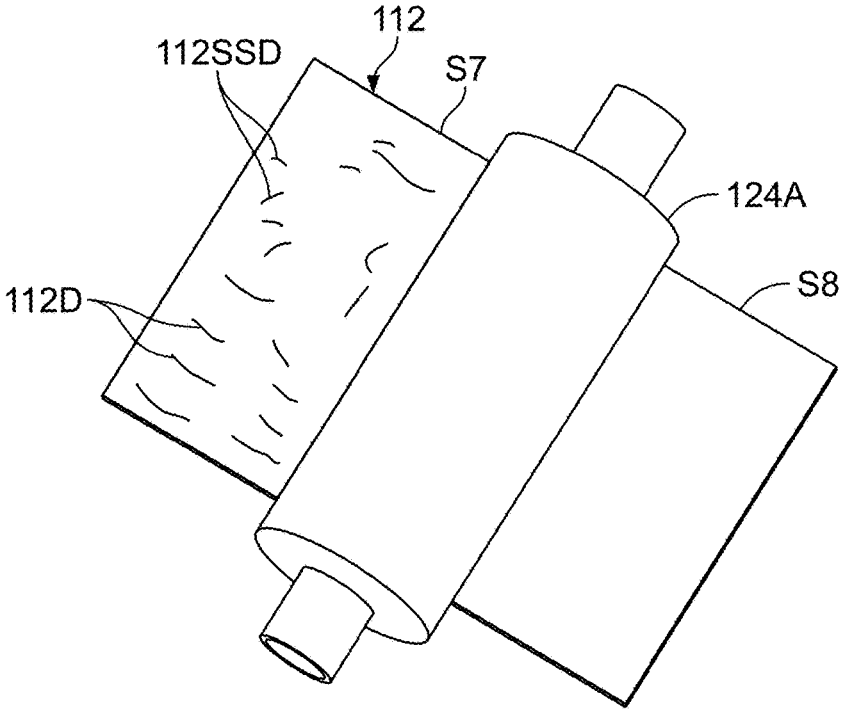
FIG. 3B is a perspective diagrammatic view of an apparatus and method for producing sheet material in accordance with an embodiment of the present disclosure.

FIGS. 3A and 3B show an alternative embodiment of the present disclosure wherein the texturing rolls 124A, 124B are placed prior to warm rolling rolls 120A, 120B, e.g., for pre-texturing slabs before rolling in a hot tandem mill. More particularly, the apparatus 110 may include a source 114 of aluminum metal that forms the sheet 112 at a first state S7 of temperature, solidification/harness, temper and dimensionality. As described above relative to source 14, there are numerous sources such as a mini-mill, a previously formed coil, etc. and therefore the source 114 is illustrated generically by a dotted rectangle. The aluminum sheet 112 at state S7 may have a temperature of 250 to 970° F., either due to retained heat or heat imposed by a heater, such as a natural gas or electrical induction heater. Texturing rolls 124A, 124B, e.g., which may have been previously surfaced by electrical discharge texturing (EDT), grinding or otherwise surfaced may be applied to the sheet 112 to impart a selected texture to the sheet 112, producing a state S8. In one example, the texturing at high temperatures may be done with a "rough" texture, e.g., with a roughness Ra in the range of 1 μm to 50 μm Ra. The texture may be in the form of a regular pattern, e.g., of rows, a grid, a series of dots, etc. that may be used to disturb the surface and potentially to redistribute metal in the sheet 112 more evenly to produce a flatter sheet with less residual stress, to disturb/obscure visible surface defects, such as lines, scratches or slab damage caused by table rolls, as well as sub-surface defects, such as voids. This texturing and repairing effect may be used to prepare the sheet 112 for further processing at another scale or "resolution" by subsequent mill stands, e.g., rolls 120A, 120B, 122A, 122B, which are not capable of erasing defects at the scale/resolution that the texture rolls 124A, 124B are capable of obliterating.

For example, the surface and sub-surface defects in the sheet 112 at state S7 may be on a first scale and the surface texture of the hot rolling rolls may be on a second scale, e.g., twice as large or twice as small when impressed on the sheet at a substantial reduction, of e.g., 30% If the sheet 112 at state S7 is subjected to texture rolls 124A, 124B having a surface texture that imparts a texture on the sheet 112 on the first scale when impressed into the sheet 112 at a 5-10% reduction, then the defects of the first scale present at state S7 will be significantly obliterated but would otherwise substantially avoid obliteration by the hot rolling rolls because their imposed texture is at a different scale. When viewed within the context of a sequential process of surface evolution by rolling at sequential rolling stands, the use of high temperature texturing may allow the development of textures specifically designed to pre-process the surface of the sheet 112 in order to pass an optimal surface on to the next set of rolls having a given set of properties and functions relative to the sheet 112, allowing hot mill process differentiation. An aspect of the present disclosure is the recognition that the rolling apparatus and process existing between a metal at a start condition or state (with a given temperature, thickness, width, surface texture, subsurface properties, temper, etc.) and a the metal at a finished condition or state (with a target temperature, thickness, width, surface texture, subsurface properties, temper, etc.), may be optimized by the use of rolling textures at various stages in the rolling operation. More particularly, the rolling process may be improved with respect to final properties (quality) of the product, as well as minimizing the time, energy, equipment and space required to achieve the target product, e.g., by reducing the number of rolling stages, the roll pressure at given stages, etc., by selectively using high temperature texture rolling at various points in the roll line, which may be used to aid in surface evolution. The present disclosure takes into consideration the initial state of the sheet and the state at each stage in the rolling process (before and after the texture rolling station(s)), as well as the final target state of the sheet, to achieve an efficient and effective evolution of the sheet and is properties, at the surface, below the surface and pertaining to hardness/temper.

After passing through the texturing rolls 124A, 124B, the sheet may then be subjected to hot rolling at low reductions by one or more stages of hot rolls 120A, 120B, 122A, 122B, etc. The texturing step may remove slab damage from table rolls preparatory to ultimately producing an isotropic surface "clean" of visible defects. The texturing may lower the rolling forces required at the rolls 120A, 120B by trapping lubricant in the undulations on the surface of the textured sheet present at state S8, which may translate into increased reduction capability, lower mill loads and/or fewer passes through roll stands to achieve a given target thickness and surface texture. The texturing step may also increase the "bite" or frictional grip of rolls 120A, 120B on the sheet 112. The increased bite may also be more evenly distributed over the surface (across the width) of the sheet, such the sheet 112 tracks straighter through the rolls 120A, 120B, 122A, 122B. Stabilization of the frictional interaction between the sheet 112 and the rolls 120A, 120B, 122A, 122B allows the sheet to pass through the rolls 120A, 120B, 122A, 122B at a steady pace. Balancing the sheet flow between stands may help in avoiding cobbles (folds) in the sheet that may otherwise occur due to uneven material flow between the stands, e.g., the sheet 112 passing through rolls 120A, 120B faster than they pass through rolls 122A, 122B. The texturing of the sheet 112 by texture rolls 124A, 124B may allow heavier reductions at the rolls 120A, 120B, 122A, 122B. The foregoing effects of texturing by rolls 124A, 124B may reduce the number of cold rolling passes that are required to repair sheet 112 damage, even with low hot mill rolling reductions, allowing casting at a thinner gauge and producing a product with a better surface, e.g. an isotropic surface suitable for anodization.

As shown in FIG. 3B, an incoming sheet 112 at state S7 which has surface defects 112D and subsurface defects 112SSD may be substantially improved and evolved in preparation for the next stage(s), e.g., warm rolls 120A, 120B and 122A, 122B. As before, the aluminum sheet 112 in state S7 is malleable and accepts the impression of the surfacing rolls 124A, 124B more readily than sheet aluminum that has been allowed to cool and temper, such that the surfacing is conducted with less pressure, to a greater extent, with greater fidelity to the surface texture of the rolls 124A, 124B and with less wear of the rolls 124A, 124B and otherwise displays the beneficial attributes of high temperature texturing described above.

Figure 4:
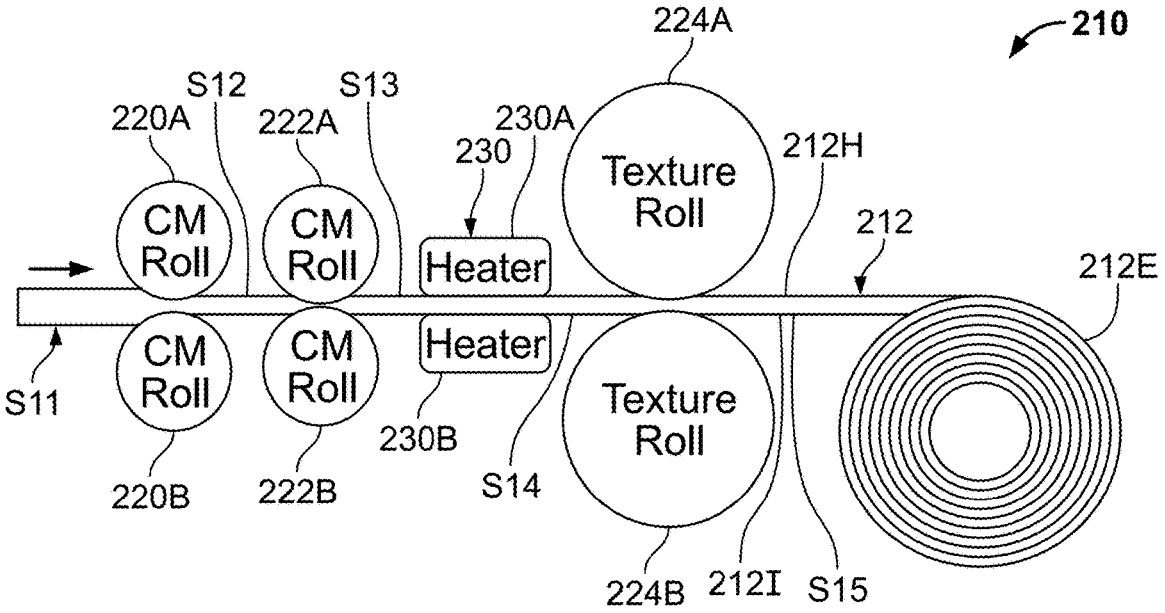
FIG. 4 is a diagrammatic view of an apparatus and method for producing sheet material in accordance with an embodiment of the present disclosure.

FIG. 4 shows an alternative embodiment of the present disclosure wherein the texturing rolls 224A, 224B are placed after cold mill rolls 220A, 220B and 222A, 222B, e.g., in the context of applying texture in-line on a cold rolling mill. The cold rolls 220A, 220B reduce the sheet in thickness at state S11 to produce the sheet 212 in state S12. The rolls 222A, 222B further reduce the thickness of the sheet 212 producing state S13. In one example, the sheet 212 may be reduced in thickness by rolls 220A, 220B by about 50% and then further reduced at rolls 222A, 222B by another 50%. The sheet 212 is then heated by a heater 230, which may utilize opposing portions 230A, 230B on either side of the sheet 212. The heater may be of a variety of types, including electric resistance, induction or natural gas. The cold working of the sheet 212 by cold rolling rolls 220A, 220B and 222A, 222B results in increases of residual stresses in the sheet 212 at stages S12 and S13, giving the sheet a higher yield strength and making it harder to roll in subsequent stands. The heater 230 may heat the sheet to 250 to 970 degrees F. thereby lowering the yield strength of the sheet 212 in state S14, facilitating rolling with texture rolls 224A, 224B and enabling higher topography transfer using lower roll force. As noted above, the depth of heat penetration on a sheet 212 may be selected/adjusted to provide a sufficient depth of penetration and softening that permits the texturing to be conducted at a given reduction and pressure.

Texture rolling at high temperatures may result in a sheet 212 at state S15 having less residual stress than present at state S14. This reduction in residual stress may translate into a flatter sheet, i.e., which exhibits its relatively greater flatness when in a free state, i.e., free of the tensions applied in the apparatus 210. The flatness of the sheet 212 may also be beneficially affected by the texturing conducted by rolls 224A, 224B, which may be selected to have a texture that is suitable for finished roll product having a texture applied by the texture rolls 224A, 224B.

The aluminum sheet 212 at state S14 may be reduced in thickness by texture rolls 224A, 224B, e.g., which may have been previously surfaced by electrical discharge texturing (EDT) or other processes, producing a state S15. If the sheet 212 at state S14 has a temperature of 250 to 970 degrees F., the texturing rolls 224A, 224B, which may have a surface roughness Ra in the range 1 μm to 10 μm Ra may be pressed against the sheet 212 at a pressure of 1 klbs/in to 10 klbs/in, producing a reduction in thickness of about 0 to 30% and transferring the surface texture of the rolls 224A, 224B to about 60 to 100% of the surfaces 212H, 2121 of the sheet 212 in state S15.

The approach of the present disclosure of texturing at high temperatures enables imparting a "rougher," e.g., 5 μm Ra, surface topology compared to room temperature conventional temper skim pass processing. The high temperatures lower the yield strength and enables higher topography transfer at lower roll force and low reductions. Typically, "rough" surface topography, high reductions and high temperatures promote adhesive metal transfer and thus subsurface damage to the sheet. The approach of the present disclosure significantly reduces adhesive metal transfer and subsurface damage by texturing at low loads, at low reduction and with little or no forward sliding. The approach of the present disclosure may be enhanced/enabled by once-through lubrication, evaporative roll cooling, use of roll surface coatings and high pressure water blasting or similar roll cleaning. The foregoing measures address the need to keep the rolls clean and at the desired temperature, as well as to control friction (by sheet lubrication) while preserving surface quality.

In accordance with an approach of the present disclosure, a texture applied to a sheet 212 may translate in some instances in the ability to eliminate rolling passes in hot or cold rolling. Another aspect of the present disclosure is that the lowered mill tonnage required reduces energy consumption and the lower reductions reduce debris generation. Less debris results in a cleaner sheet 212. The reduction of force levels and debris generation also correspond to less wear on the texturing rolls 224A, 224B leading to longer roll life and fewer roll changes. Reducing the number of roll changes due to lower roll topography wear lowers the sheet surface roughness Ra variability form one coil 212E to the next, e.g., a coil of sheet 212 prepared at the end of texturing roll 224A, 224B life vs. one that is prepared using a newly textured roll 224A, 224B. The lower costs associated with high temperature texture rolling, e.g., by eliminating rolling passes, lowers the cost of textured sheet 212E, thereby making the texturing process available for more products. The elimination of roll passes reduces the usage of rolls in a given mill expanding the output capacity of the mill over a given time period.

Figure 5:
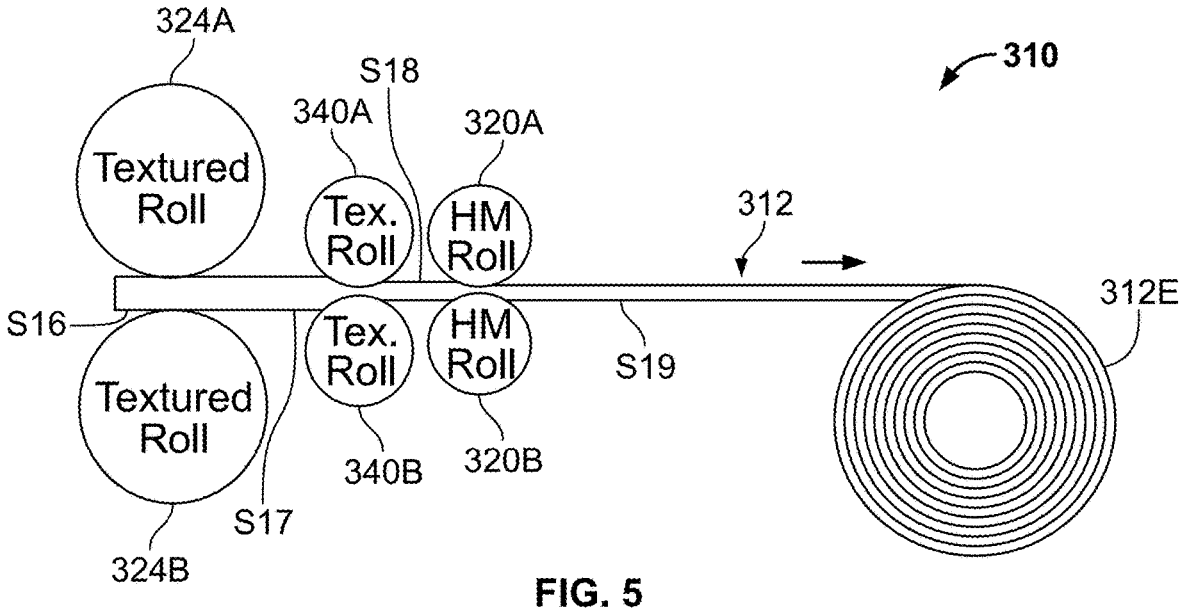
FIG. 5 is a diagrammatic view of an apparatus and method for producing sheet material in accordance with an embodiment of the present disclosure.

FIG. 5 shows an apparatus 310 for producing sheet material 312, such as aluminum sheet. The apparatus 310 has two sets of texture rolls, 324A, 324B and 340A, 340B, which may be placed sequentially in the flow direction of the sheet 312. The sheet 312 is passed to the rolls from any given source, e.g., prior rolls in a rolling or casting mill and may be cooled or heated to exhibit an elevated temperature of, e.g., 250 to 970° F., at state S16, allowing high temperature texturing by the texture rolls, 324A, 324B and 340A, 340B. This high temperature texturing has all the features and properties described above. The texture rolls 324A, 324B may be large diameter rolls and take a low to no reduction pass at the sheet 312. Texture rolls 340A, 340B may be smaller in diameter and may make larger reductions in the sheet 312. In one alternative, a working roll stand of a hot mill may be textured to produce texture rolls 340A, 340B. As noted above, high temperature texturing may be used to alter a surface of a sheet 312 in preparation for subsequent treatment by a subsequent roll stand. In apparatus 310, the sequence of texture rolling by roll sets 324A, 324B and 340A, 340B may be used to impart sequential/ supplemental textures to the sheet 312 to achieve step-wise surface evolution. In one example, the first set of texture rolls 324A, 324B has a surface roughness Ra of 1 to 10 and the second set 340A, 340B has a roughness Ra of 1 to 5, the first set of rolls imparting a texture with a greater roughness Ra that more significantly disrupts the surface and the sub-surface, followed by the second set of texture rolls 340A, 340B having a texture that is less rough that only partially obliterates the pattern imparted by the texture rolls 324A, 324B. Sequential high temperature texturing may be used to prepare the sheet for subsequent, enhanced rolling by hot rolls, e.g., 320A, 320B or alternatively, cold rolls.

The foregoing sequential texturing may be used to decrease grain size and break up the incoming surface in the sheet 312, diminishing "orange peel" in the resultant sheet 312 at state S19 and producing a more isotropic clean surface, particularly when anodized. An isotropic slab topography produced by texturing at high temperatures may facilitate lowering the force at subsequent roll stands, e.g., at rolls 320A, 320B, help tracking, reduce cobbles, allow heavier reduction reduce rolling passes, allow casting at a thinner gage, reduce the number of cold rolling passes to repair damage in the sheet 312 and improve surface quality. The sequential texturing approach illustrated in FIG. 5 all enhances the ability to produce a greater variety of sheet 312 textures, in that multiple sequential texture rolling passes are superimposed and represented in the final rolled sheet 312 at stage S19. The foregoing, high temperature, sequential texturing may be facilitated by once-through lubrication, evaporative roll cooling, use of roll surface coatings and high pressure water blasting or similar roll cleaning processes.

Figure 6:
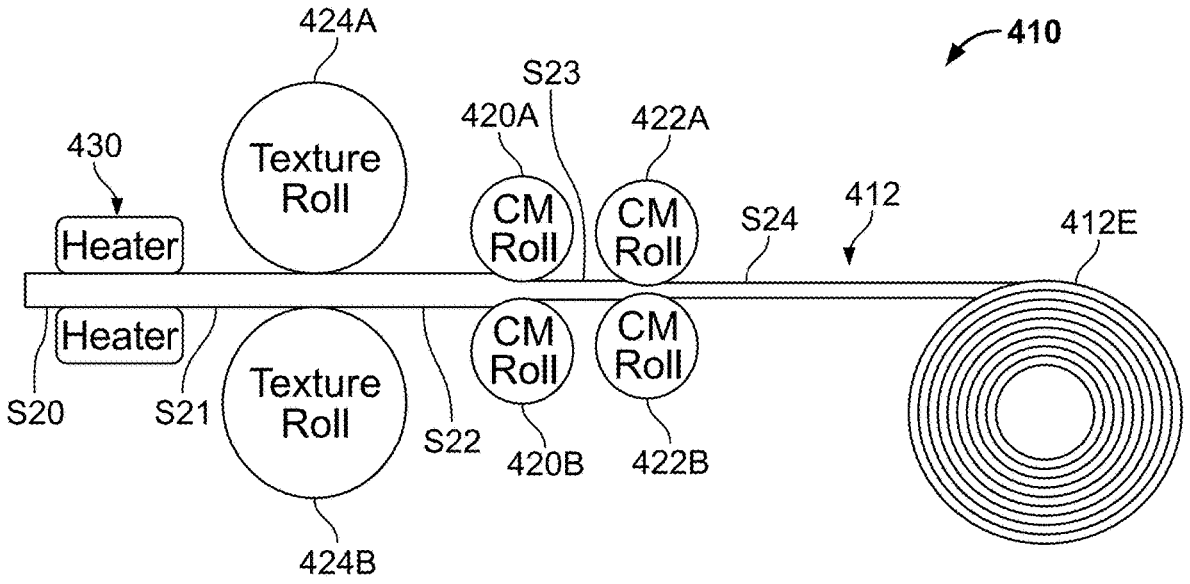
FIG. 6 is a diagrammatic view of an apparatus and method for producing sheet material in accordance with an embodiment of the present disclosure.

FIG. 6 shows an apparatus 410 for producing sheet material 412, such as aluminum sheet. The apparatus 410 has a heater 430 for raising the temperature of a in flowing sheet 412, which may be from a variety of sources, such as a cold rolling mill stand, casting mill, etc. The heater 430 raises the temperature of the sheet 412 at state S20 to 250-970° F. at state S21 in order to conduct high temperature texturing by texture rolls 424A, 424B. This high temperature texturing has all the features and properties described above, viz., allows texturing with a rough surface topography to disturb the surface of the sheet 412, redistributing the metal more evenly and improving surface quality prior to further processing. The high temperature texturing allows texturing at low loads and low reductions with little or no forward sliding and with a reduced tendency to cause sub-surface damage. Because the sheet 412 is softened by heating, lowering the yield strength, the pressure on the texturing rolls 424A, 424B may be reduced while still achieving high topography transfer. After having passed through texturing rolls 424A, 424B, the sheet may then be rolled by cold roll set 420A, 420B producing state S23 and then by cold rolls 422A, 422B. Apparatus 410 could be described as pre-texturing hot sheet 412 prior to cold rolling. As noted above, high temperature texturing may be used to alter a surface of a sheet 412 in preparation for subsequent treatment by a subsequent roll stand. In apparatus 410, the sequence of texture rolling by roll sets 424A, 424B and 420A, 420B may be used to impart sequential/supplemental textures to the sheet 412 to achieve step-wise surface evolution. In one example, the texture rolls 424A, 424B has a surface roughness Ra of 1 μm to 50 μm Ra and the first set of cold rolls 420A, 420B has a roughness Ra of 1 μm to 5 μm Ra, the texture rolls 424A, 424B imparting a texture with a greater roughness Ra that more significantly disrupts the surface and the sub-surface, followed by the first set of cold rolls 420A, 420B having a texture that is less rough that only partially obliterates the pattern imparted by the texture rolls 424A, 424B and which make a substantial reduction in thickness. The second set of cold rolls 422A, 422B may then further reduce the thickness and/or impart an additional texture to the sheet 412. The effect of the texturing rolls 424A, 424B may enhance and facilitate cold rolling by rolls 420A, 420B and 422A, 422B, e.g., by imparting pockets to the sheet 412 at state S22 which may retain lubricant. Enhanced cold rolling may eliminate a cold pass and produce a sheet at state S24 with an isotropic matte finish with fewer blemishes. The improved texture transfer associated with high temperature texturing may also lead to a more consistent surface on the sheet 412 at state S24. The foregoing, high temperature, texturing followed by cold rolling may be facilitated by once-through lubrication, evaporative roll cooling, use of roll surface coatings and high pressure water blasting or similar roll cleaning processes.

Figure 7:
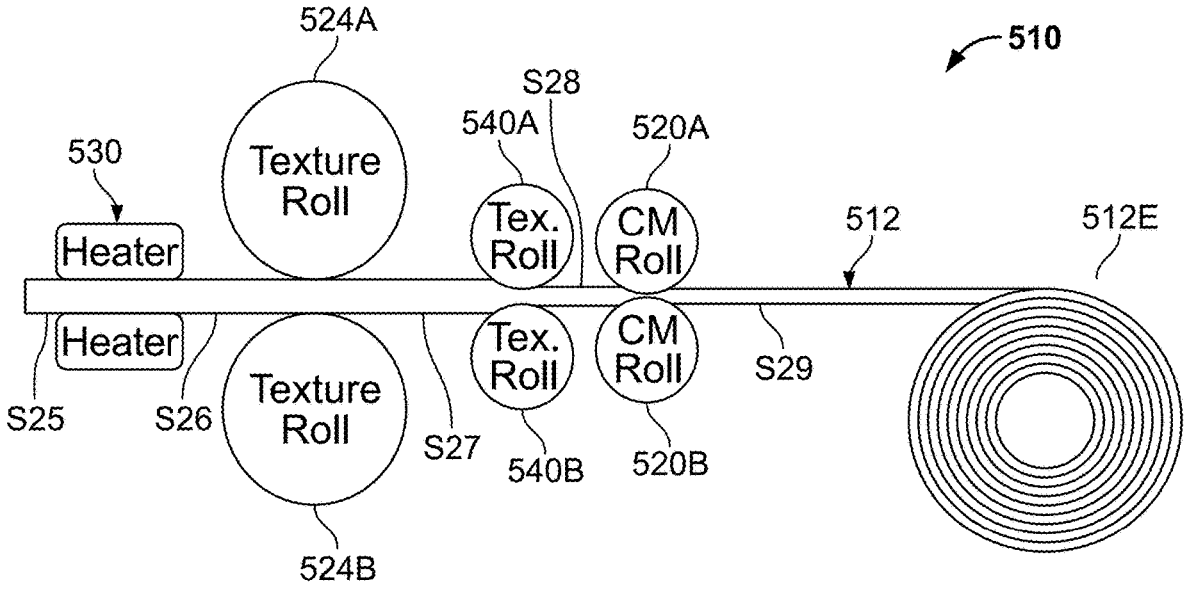
FIG. 7 is a diagrammatic view of an apparatus and method for producing sheet material in accordance with an embodiment of the present disclosure.

FIG. 7 shows an apparatus 510 for producing sheet material 512, such as aluminum sheet. The apparatus 510 has a heater 530 for raising the temperature of an in-flowing sheet 512, which may be from a variety of sources, such as a cold rolling mill stand, casting mill, etc. The heater 530 raises the temperature of the sheet 512 at state S25 to 250-970° F. at state S26 in order to conduct high temperature texturing by texture rolls 524A, 524B. This high temperature texturing has all the features and properties described above, viz., allows texturing with a rough surface topography to disturb the surface of the sheet 512, redistributing the metal more evenly and improving surface quality prior to further processing. The high temperature texturing allows texturing at low loads and low reductions with little or no forward sliding and with a reduced tendency to cause sub-surface damage. Because the sheet 512 is softened by heating, lowering the yield strength, the pressure on the texturing rolls 524A, 524B may be reduced while still achieving high topography transfer in the sheet 512 at state S27. After having passed through texturing rolls 524A, 524B, the sheet may then be rolled by a second set of texturing rolls 540A, 540B producing state S23 and then by cold rolls 520A, 520B yielding the sheet 512 in state S29. Apparatus 510 could be described as pre-texturing hot sheet 512 in two texturing passes prior to cold rolling. The texture rolls 524A, 524B may be large diameter rolls and take a low reduction pass on the sheet 512. Texture rolls 540A, 540B may be smaller in diameter and may make larger reductions in the sheet 512. In one alternative, a working roll stand of a hot mill may be textured to produce texture rolls 540A, 540B. As noted above, high temperature texturing may be used to alter a surface of a sheet 512 in preparation for subsequent treatment by a subsequent roll stand. In apparatus 510, the sequence of texture rolling by roll sets 524A, 524B and 540A, 540B may be used to impart sequential/supplemental textures to the sheet 512 to achieve step-wise surface evolution. In one example, the first set of texture rolls 524A, 524B have a surface roughness Ra of 1 μm to 50 μm Ra and the second set 540A, 540B have a roughness Ra of 1 μm to 5 μm Ra, the first set of rolls imparting a texture with a greater roughness Ra that more significantly disrupts the surface and the sub-surface, followed by the second set of texture rolls 540A, 540B having a texture that is less rough that only partially obliterates the pattern imparted by the texture rolls 524A, 524B. Sequential high temperature texturing may be used to prepare the sheet for subsequent, enhanced rolling by cold rolls, e.g., 520A, 520B.

As noted above, high temperature texturing may be used to alter a surface of a sheet 512 in preparation for subsequent treatment by a subsequent roll stand. In apparatus 510, the sequence of texture rolling by roll sets 524A, 524B and 540A, 540B may be used to impart sequential/supplemental textures to the sheet 512 to achieve step-wise surface evolution. In one example, the texture rolls 524A, 524B has a surface roughness Ra of 1 μm to 50 μm Ra and the second set of texture rolls 540A, 540B have a roughness Ra of 1 μm to 5 μm Ra, the texture rolls 524A, 524B imparting a texture with a greater roughness Ra that more significantly disrupts the surface and the sub-surface, followed by the second set of texturing rolls 540A, 540B having a texture that is less rough that only partially obliterates the pattern imparted by the texture rolls 524A, 524B and which make a substantial reduction in thickness. The cold rolls 520A, 520B may then further reduce the thickness and/or impart an additional texture to the sheet 512. The effect of the texturing rolls 524A, 524B and 540A, 540B may enhance and facilitate cold rolling by rolls 520A, 520B, e.g., by imparting pockets to the sheet 512 at state S28 which may retain lubricant. Enhanced cold rolling may eliminate a cold pass and produce a sheet at state S29 with an isotropic matte finish with fewer blemishes. The improved texture transfer associated with high temperature texturing may also lead to a more consistent surface on the sheet 512 at states S27 and S28. The foregoing, high temperature, texturing followed by cold rolling may be facilitated by once-through lubrication, evaporative roll cooling, use of roll surface coatings and high pressure water blasting or similar roll cleaning processes. After achieving state S29, the aluminum sheet 512 may be heat treated, hardened and/or tempering. The aluminum sheet 512 may then be coiled into a coil 512E for storage and transport via conventional methods.

In accordance with aspects of the present disclosure, adding textures to sheet at the end of a continuous caster process decreases cost significantly when added in-line. Additional coiling and uncoiling may not be necessary and the lower as cast and rolled F temper properties allow increased topography transfer. The latter may enable lower reductions and longer roll life to achieve topographies similar to traditional textures or new differentiated surfaces through increased topography transfer. Lower reductions will also decrease debris generation minimizing the need to clean some textures such as EDT. Incoming surface quality issues raised by processes, such as caster heat treatment, may be carried out after texturing per standard heat treatment practices. Adding textures to a continuous caster product in an additional step may allow further topography transfer control dependent on the properties of the desired product e.g., F, O or T tempered. Additional post-texture heat treatments may also be added as needed. Another potential advantage to adding a texture in line or at line to the continuous cast product surface is the ability to create uniform surfaces minimizing surface features from caster or rolling operations.

EDT is used in finish rolling to prepare a matte finish, non-directional sheet for appearance and formability enhancement. Other texturing processes that could deliver similar results include: abrasive or sandblasted rolls, cross or inclined angle ground rolls, laser or e beam textured, nodular chrome plating deposits such as TopoCrom™, other high nodule chrome processes and ball or shot peened rolls.

Aspects of the present disclosure include potential benefits in longer texture roll life, unique textures from improved topography transfer, lower cost through minimizing coiling and uncoiling operations if in line, consistent surfaces, higher recovery through eliminating caster and rolling surface artifacts and lower mill loads. If EDT or a similar texture is used on a hot roll mill (HRM), two further advantages may be obtained, viz., with the right combination of lubricant and texture, heavier reductions may be taken without bite refusals, thus enabling pass elimination. This may be a critical enabler to eliminate the practice of Kerosene Bite assist.

An advantageous aspect of adding a texture in line or at line to the continuous cast product surface is the ability to create uniform surfaces minimizing surface features from the caster or rolling operations. Texturing (with low cost, low load equipment) immediately after a continuous caster, Micromill™, roll coater or slab caster can redistribute, remove or mask features that prohibit use in critical surface applications, e.g., when the topography produced by a Micromill™ leaves the cast metal with undesired features and/or patterns in the surface. Using the teachings of the present disclosure to texture surfaces in the hot rolling process may be used to reduce or eliminate appearance issues in a subsequently anodized surface. This may enable low cost approaches to be used to make sheet for higher surface critical applications.

In the course of utilizing the method and apparatus of the present disclosure, a lubricant, such as a hot rolling dispersion, was applied to the sheet prior to its entry into the nip between a first stand of hot mill work rolls. Very low roll coating was experienced, contrary to an expected high degree of roll coating due to the "rough" nature of the EDT topography. It was also noted that rolling in a two stand mill was greatly enhanced. First, the roll bite "stability" was greatly enhanced, leading to much better sheet steering behavior, which facilitated the rolling process. This enhanced stability may have been attributable to lower loads at heavier reductions than expected. It was expected that the higher friction of the stand 1 EDT work rolls would lead to higher load forces and would limit reduction capability, but this dynamic was not observed. During standard rolling conditions featuring 57% reduction in stand 1, load forces experienced with EDT rolls were not higher than the load forces experienced with standard ground rolls. Operating with EDT rolls in stand 1 did enable an increase in reduction capability up to ~70% without significant load force increase, something not possible with ground topography. Additionally, presenting sheet from stand 1 with EDT texture to stand 2 caused a notable reduction in load force. The apparatus and method of the present disclosure exhibits lower loads, greater reductions and less debris and surface degradation than expected.

While EDT is used in finish rolling to prepare matte finish, non-directional sheet for appearance & formability enhancement, other texturing methods may be used to prepare texturing rolls, e.g., 24A, 24B for use in an apparatus of the present disclosure. For example, EDT vendors do not presently have equipment to handle all sizes of hot mill work rolls, due to their dimensions and weight. There are other texturing processes that could deliver similar results as EDT, e.g., sandblasted rolls, cross grind, TopoCrom, other high nodule chrome processes and ball or shot peened rolls.

As noted above, the source 14, 114, etc. of aluminum metal may be varied and may have been previously produced either by casting ingots from a melt, which are then rolled down to a thickness of, e.g., 0.125 or 0.250 in., or by a continuous casting process. In processing to a finished sheet product, the present disclosure recognizes that it would be beneficial to eliminate features affecting surface quality and to reduce the amount of work and energy required to accomplish that end.

Figure 8:
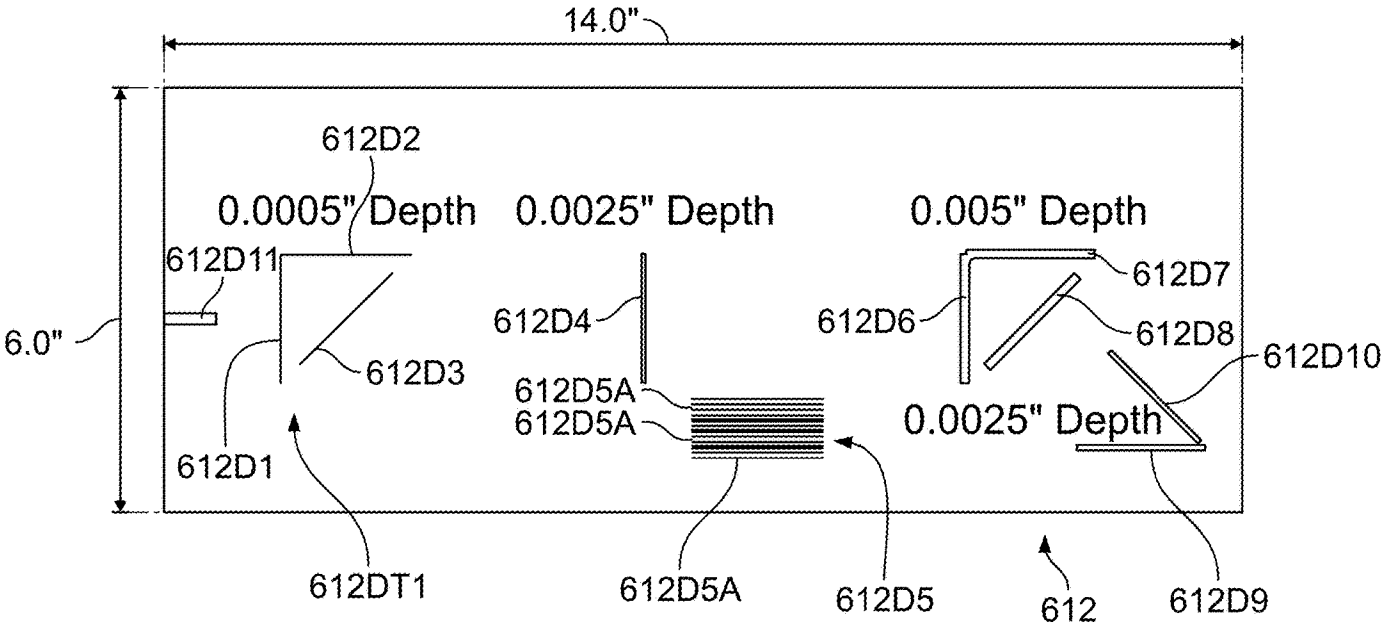
FIG. 8 is a diagrammatic view of a pattern of surface scratches in a sheet with different depths and orientations.

FIG. 8 shows a plurality of planned virtual surface scratches 612D1, 612D2, 612D3, 612D4, 612D5A, 612D6, 612D7, 612D8, 612D9, 612D10, 512D11 in a virtual sheet 612. The virtual scratches 612D5A are multiple and parallel one to another, forming a subpattern 612D5 and others of the virtual scratches, e.g., 612D1, 612D2, 612D3 are juxtapositioned relative to one another such that they can be related by the viewer into a pattern, e.g., an incomplete triangle 612DT1. In the event that a scratch or other defect, 612D5 can convey a perceptible pattern, it may be more observable to a person than a scratch or defect having no perceptible pattern and being perceived as random. In a similar way, a scratch 612D4 is perceptible in that it is presented on a background 612B or area of the sheet 612 which has otherwise unvarying optical properties, such that the difference between the scratch 612D4 is perceptible relative to the background 612B as a localized area having a different optical property than the background 612B. While scratches, e.g., 612D1, which is a localized areas lower than the background 612B surface, are described, it should be appreciated that the present disclosure is intended to and can be readily seen to describe methods and apparatus that can be effective at altering other types of surface defects, e.g., those attributable to defects that protrude above the background surface 612B or that oscillate above and below the background surface 612B or have optical, e.g., reflective properties differing from the background 612B. It is understood that any surface, when inspected at a high enough magnification, will be seen as "rough" or highly varying and furthermore that the perception of a defect may be lost if the magnification is great enough that the defect itself fills the visual field. In accordance with one approach, to more specifically point out the magnitude or scale of the defects of interest, they may be defined as those which are perceptible at 1× magnification to 100× magnification. Alternatively, one could define the defects of interest as observable with normal human vision (unaided) at a distance of 0.1 to 5 feet. In a further alternative, a range of roughness Ra which would qualify as background surface with imperceptible defects would be 0.1 μm Ra to 2 μm Ra. Any feature exceeding this roughness Ra when juxtaposed next to a background surface would be considered to be a surface defect. An aspect of the present disclosure is that the apparatus and methods described above can be used to partially or completely obscure or obliterate perceptible defects in the surface of a sheet like those in virtual sheet 612, as will be explained further in the examples described below.

Figure 9B:
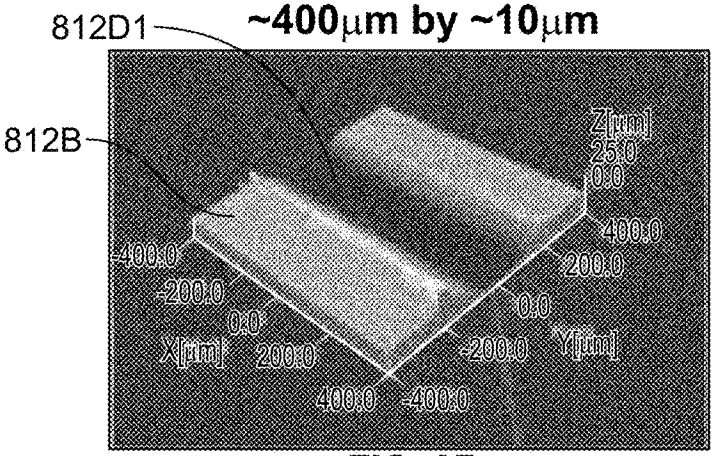
FIGS. 9A and 9B are optical and topography images, respectively, of a first scratch pattern in a surface
Figure 9A:
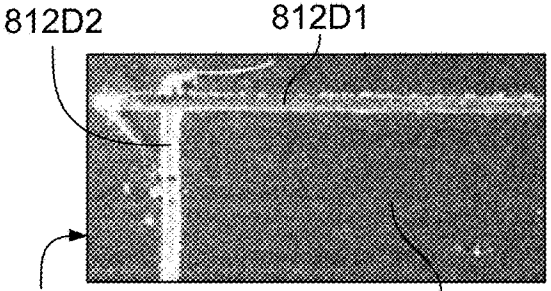

FIG. 9A shows an optical image of a sheet 812 of aluminum alloy of the type 3XXX with the ends of scratches 812D1 and 812D2 in background surface 812B having a depth of about 10 μm, a width about 400 μm wide and a length of 50 mm. These scratches were made with a TABER® Linear Abraser (Abrader) having adjustable settings enabling the user to select the speed, stroke length and test load. Different test loads were used to create scratches in the test samples. FIG. 9B shows a topography image of the scratch 812D1 obtained by a white light phase shift interferometer instrument).

Figure 9C:
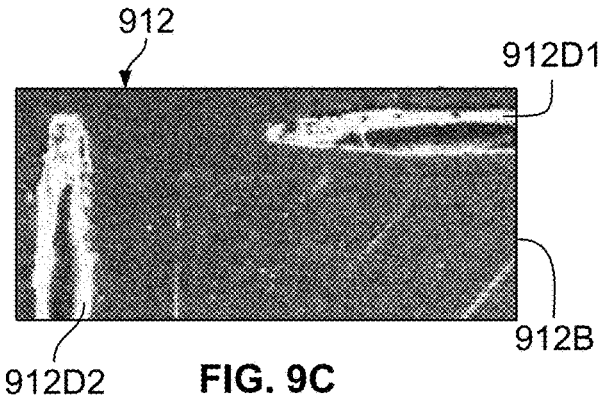
FIGS. 9C and 9D are optical and topography images, respectively, of a second scratch pattern in a surface.
Figure 9D:
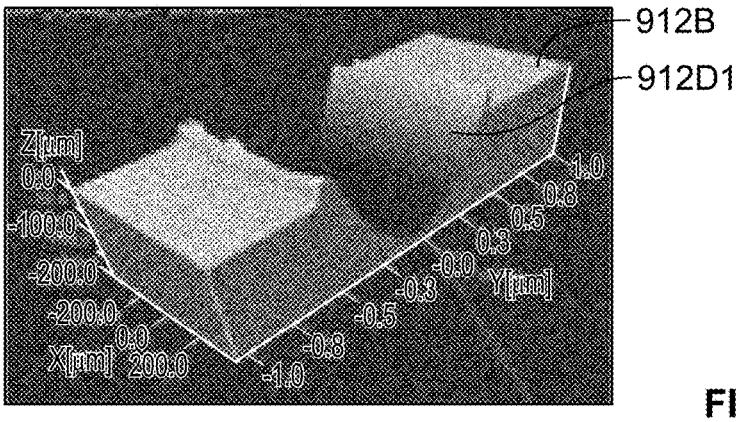

FIG. 9C shows an optical image of a sheet 912 of aluminum alloy of the type 3XXX with the ends of scratches 912D1 and 912D2 in background surface 912B having a depth of about 200 μm, width of about 1000 μm and a length of 50 mm. These scratches were made with a TABER® Linear Abraser (Abrader) having adjustable settings enabling the user to select the speed, stroke length and test load. Higher test loads were used to create deeper scratches in these test samples compared to FIG. 9A. FIG. 9D shows a topography image of the scratch 912D1 obtained by a white light phase shifting interferometer instrument).

Figure 10:
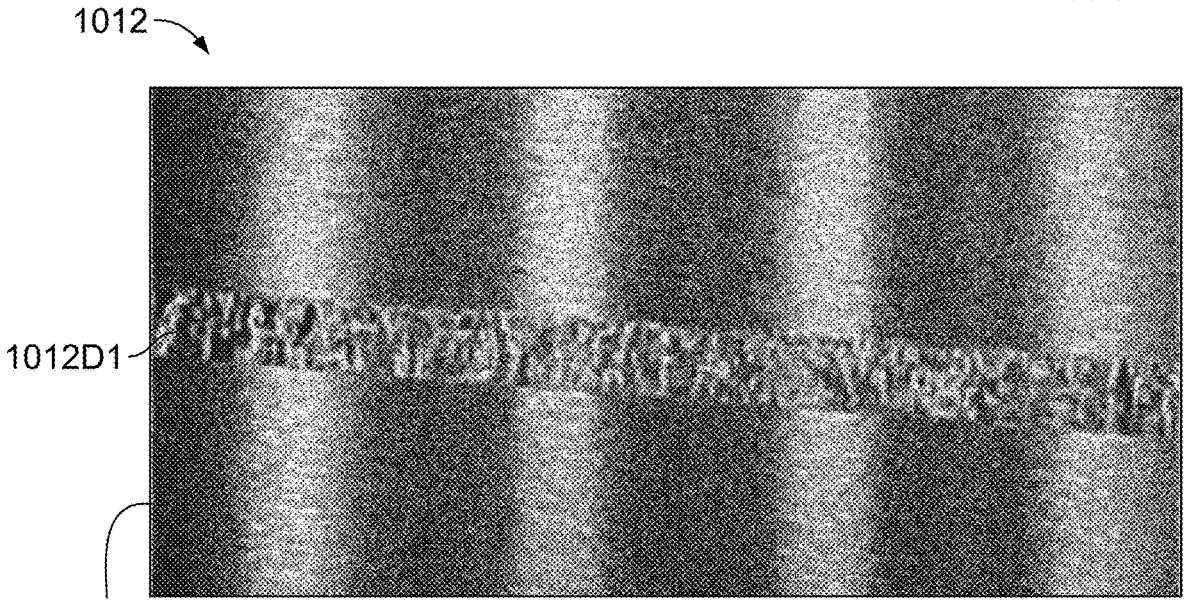
FIG. 10 is an optical image of a surface sliver present on the surface of a metal sheet or slab that may be seen in rolling caused by metal sticking and being rolled into the slab/sheet surface.

FIG. 10 shows an optical image of a surface sliver 1012D1 present on the background surface 1012B of a metal sheet or slab 1012. This type of surface defect may be seen as a consequence of rolling operations and may be caused by metal sticking to a roll and then being rolled or impressed into a surface of the slab/sheet.

Figure 11:
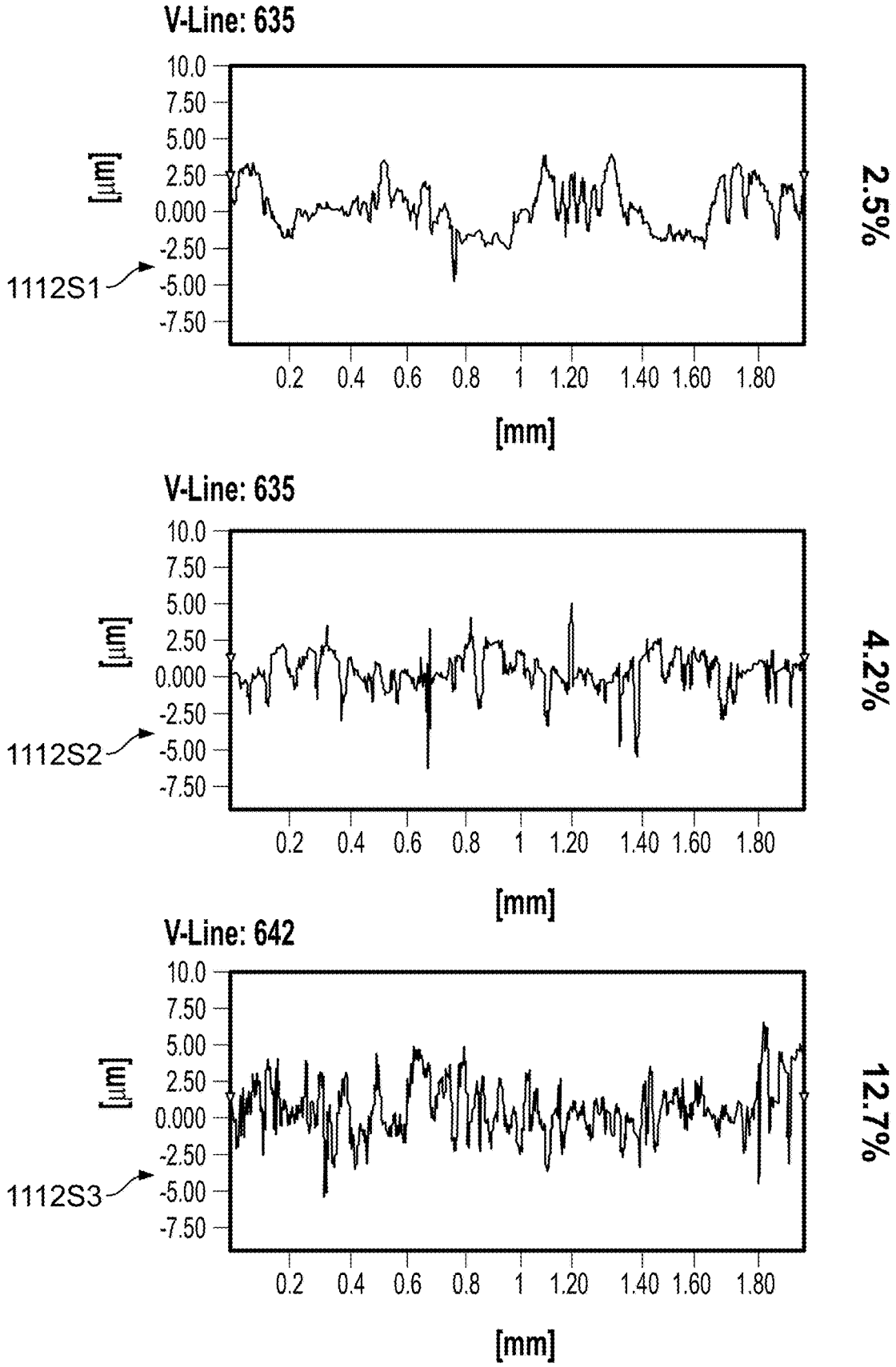
FIG. 11 is a series of surfaces topography scans for five different reduction percentages with an EDT roll on sheet aluminum produced in accordance with an embodiment of the present disclosure.
Figure 11:
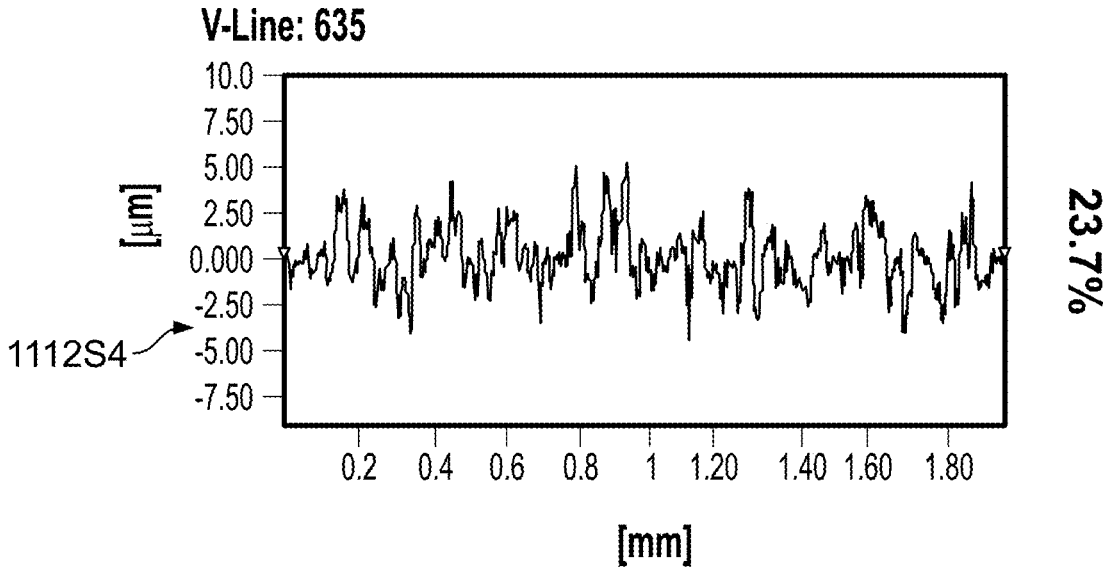
Figure 11:
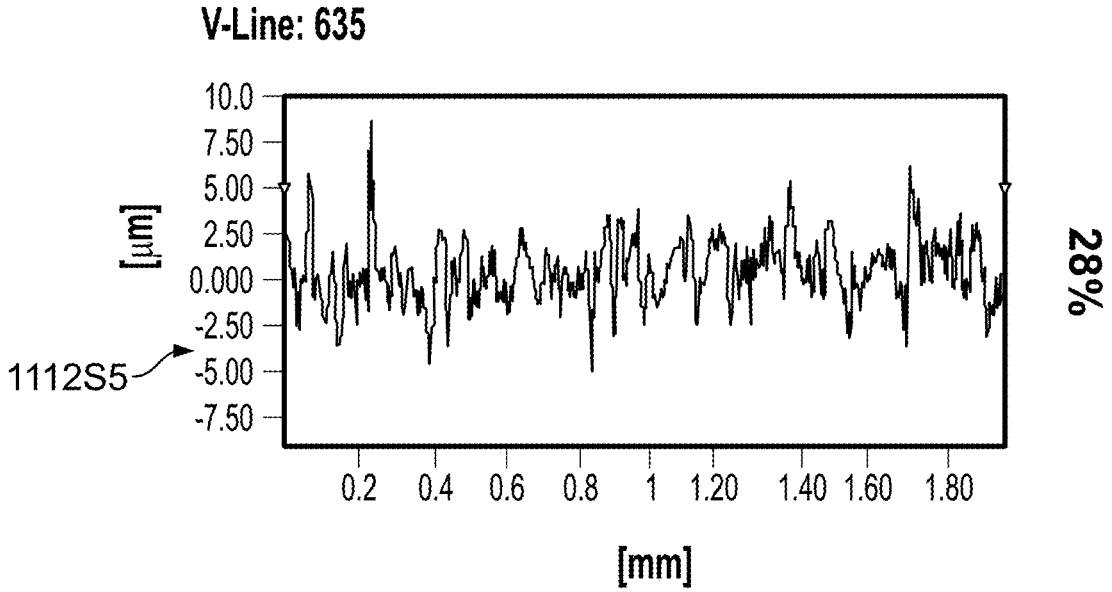

FIG. 11 shows a series of surfaces topography scans 112S1-112S5 of a rolled aluminum sheet 12 (FIG. 1) for five different reduction percentages with an EDT roll 18A, 18B with a surface roughness Ra of 5 μm on sheet aluminum of type 5XXX produced in accordance with an embodiment of the present disclosure. The sheet aluminum was reduced in thickness by an apparatus 10 like that shown in FIG. 1 to varying percentage reductions (2.5%, 4.2%, 12.7%, 23.7% and 28%), respectively. The source 15 (FIG. 1) of the aluminum sheet was a Micromill™ or a mill as described in any one of U.S. Pat. Nos. 5,515,908, 5,655,593, 5,894,879, 5,772,799, 5,772,802, 6,045,632, 5,769,972, 6,102,102, 6,391,127, 6,623,797, 6,672,368, 7,089,993, 7,503,377, 7,125,612, 6,581,675, 7,182,825, 8,403,027, 7,846,554, 8,697,248, 8,381,796 or 8,956,472, which are incorporated by reference herein. The texturing rolls 24A, 24B used were textured by EDT. The reductions were conducted on the sheet when the sheet was at 930° F. and the topography scans were taken at stage after quenching in the roll line. As can be appreciated, the surface topography scans show more uniform peaks and valleys replicating the EDT topography as reduction increases. As can be appreciated, the sheet output of a specific Micromill™ will vary in accordance with the operating parameters of the Micromill™, including surface quality, output temperature, thickness and alloy composition. The operating parameters of the high temperature texture rolling disclosed in the present application can be adjusted to accommodate the specific output properties of the sheet from a Micromill™ as described in the above listed patents incorporated by reference, with respect to temperature, reduction % and roughness Ra, to achieve the advantages described herein. In one example, the output sheet of a Micromill™ may be in a temperature range of 1100 to 1000 degrees Fahrenheit. After exiting the Micromill™ and exposure to ambient temperatures and handling equipment, such as a caster and/or transfer belt, the sheet will cool and solidify to a temperature permitting rolling and/or high temperature texture rolling, as taught in the present disclosure. This may be conducted at a temperature exceeding 970° F., given that the casting conditions, e.g., throughput rate, state of solidification and alloy composition allow, otherwise, steps can be taken to allow increased cooling to occur between the mill output and the first rolling stand, e.g., increasing the distance between them or reducing throughput rate.

Figure 12:
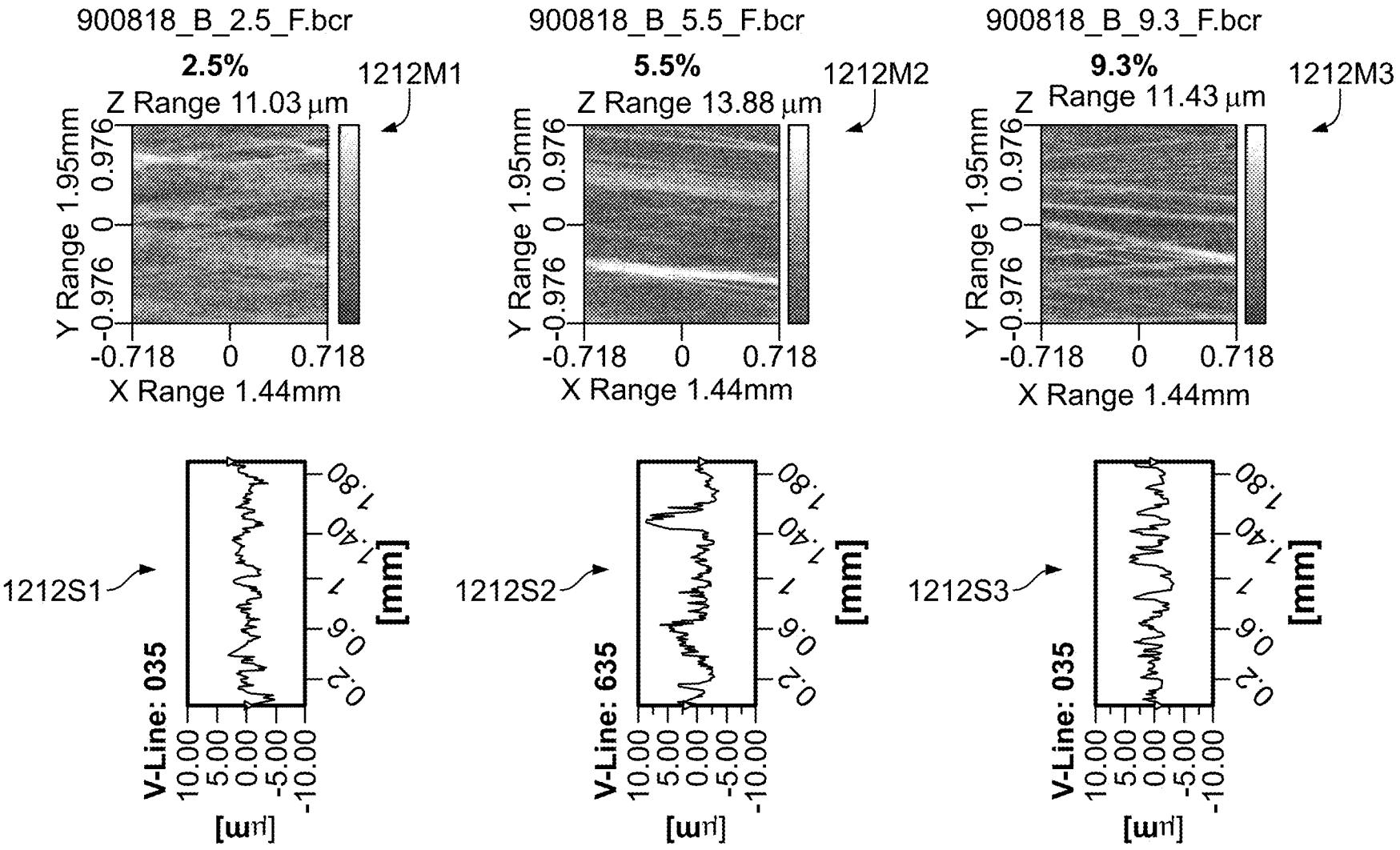
FIG. 12 is a series of surface topography maps and line profiles for five different reduction percentages with a cross hatch roll on sheet aluminum produced in accordance with an embodiment of the present disclosure.
Figure 12:
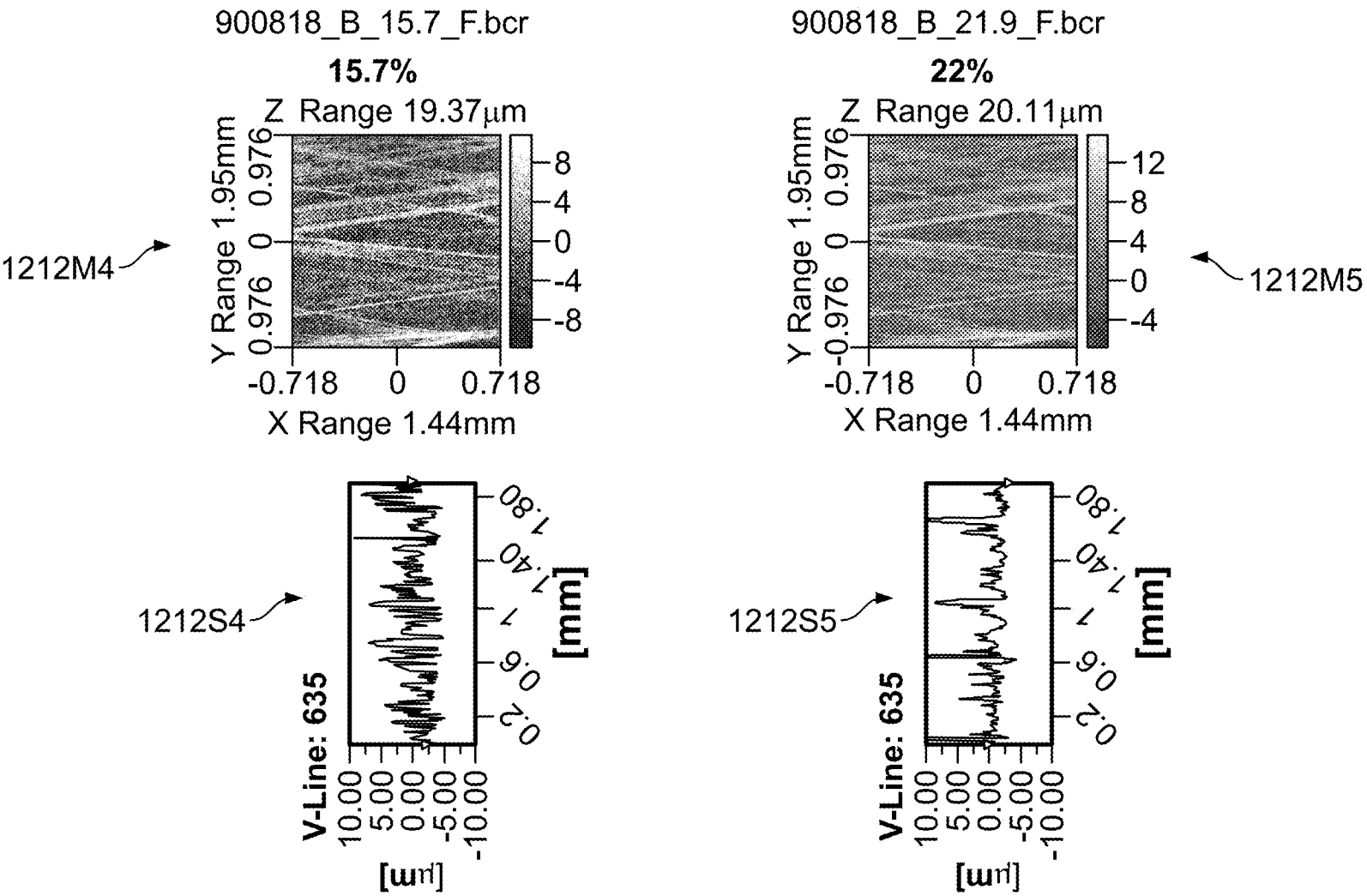

FIG. 12 shows a series of surface topography maps 1212M1-1212M5 and line profiles 1212S1-1212S5 of a rolled aluminum sheet 12 for five different reduction percentages with a cross hatch roll 24A, 24B with a surface roughness Ra of 5 μm on sheet aluminum of a type 5xxx produced in accordance with an embodiment of the present disclosure. The sheet aluminum was reduced in thickness by an apparatus 10 like that shown in FIG. 1 to varying percentage reductions (2.5%, 5.5%, 9.3%, 15.7% and 22%). The texturing rolls 24A, 24B used were textured by cross hatch grinding. The reductions were conducted on the sheet when the sheet was at 930° F. and the topography scans were taken at stage after quenching in the roll line. As can be appreciated, the surface topography scans show a large variability in peaks and valleys with some deep and undesirable surface features remaining consistent with the features in the ground cross hatch roll.

Figures 13A, 13B, 13C:
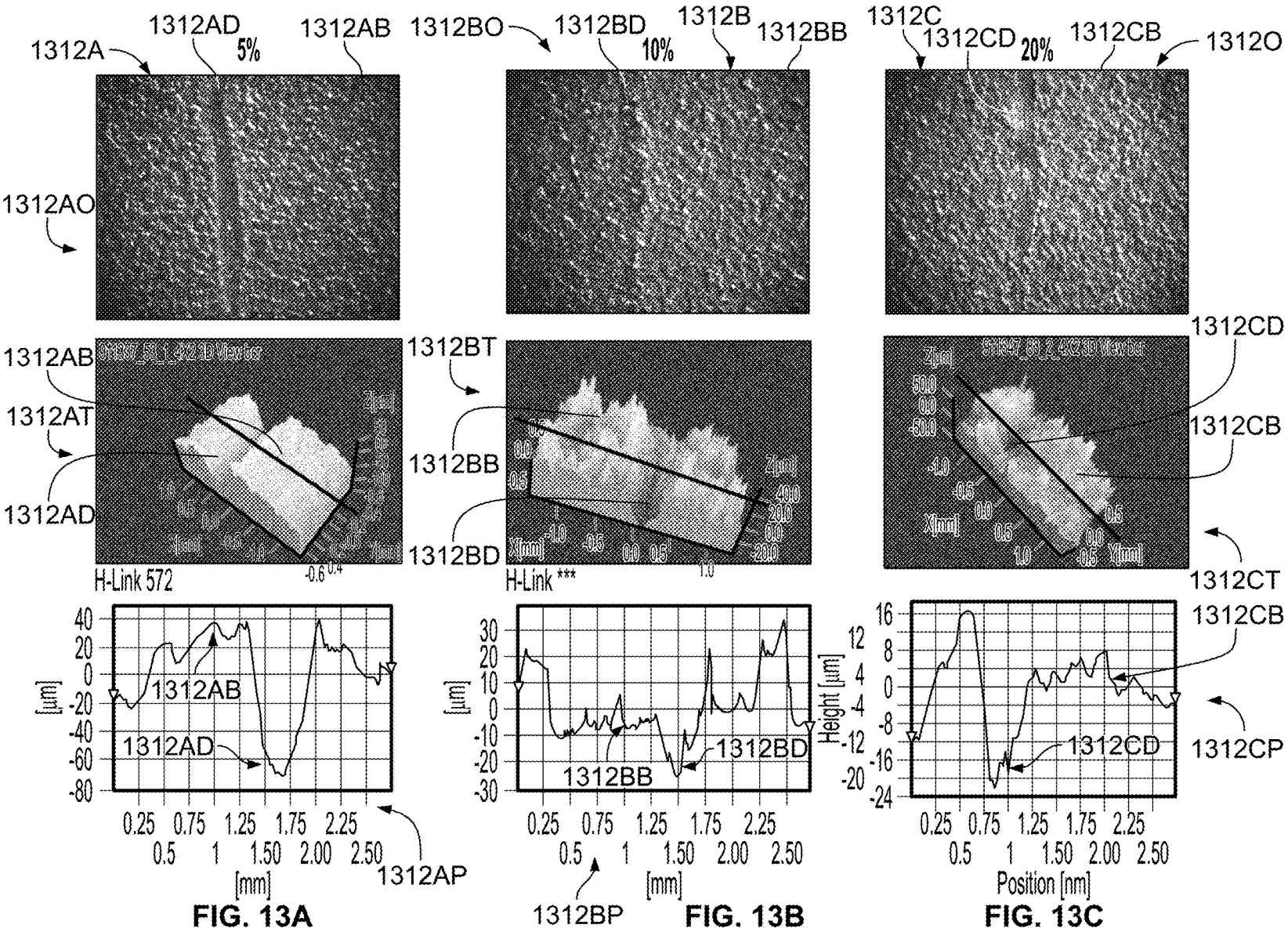
FIGS. 13A, 13B and 13C are each a series of optical image, topographic image and line profile for a respective sheet sample, each with a surface scratch, before and after rolling with a 600 μin Ra EDT roll at 850 F at three different reductions.

FIG. 13A shows a series of optical image 1312AO, topographic image 1312AT and line profile 1312AP for a sheet sample 1312A, with a surface defect 1312AD (scratch) in a background surface 1312AB after rolling with a 600 μin (15 μm) Ra EDT roll at 850 F at 5% reduction in thickness. Prior to reduction rolling The sheet sample had a background surface having a roughness Ra of 1 μm with a scratch having a depth of about 1000 μm, as shown in FIGS. 9C and 9D. As can be appreciated from FIG. 13A, the 5% reduction with the EDT texture roll, has reduced the perceptibility of the scratch 1312AD relative to that shown in FIGS. 9C and 9D. As demonstrated by the topographic image 1312AT and the line profile 1312AP, this reduction in visual perceptibility of the scratch 1312AD can be observed in the changes in surface dimensions, namely, average peak to valley difference, which is 45% less than in the sheet prior to rolling. Increasing the reduction to 10% in FIG. 13B and 20% in 13C decreases the scratch depth by 70% and 80% respectively.

Figures 14A, 14B, 14C:
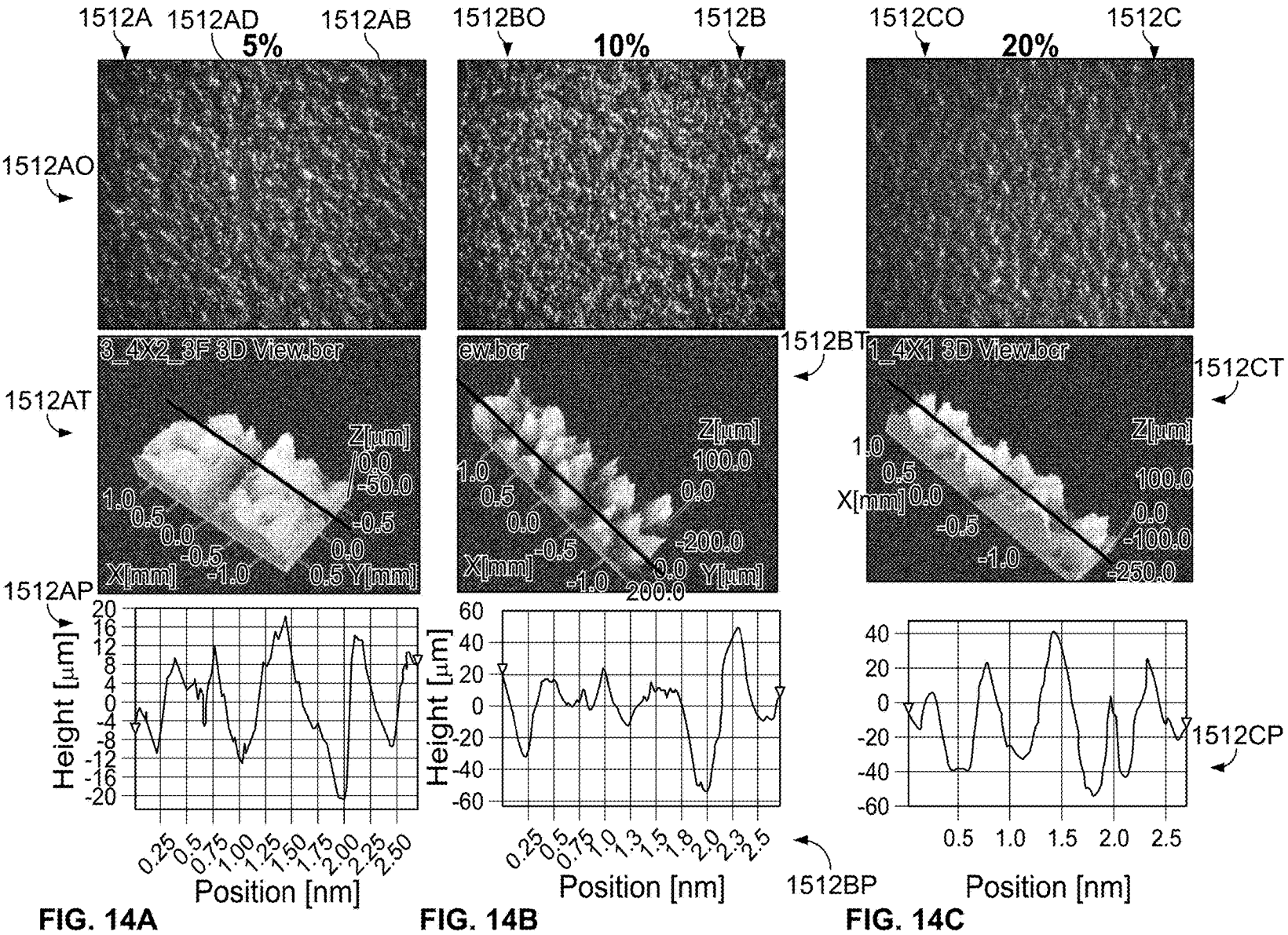
FIGS. 14A, 14B and 14C are each a series of optical image, topographic image and line profile for a respective sheet sample, each with a surface scratch, before and after rolling with a 1200 μin Ra EDT roll at 850 F at three different reductions.

FIG. 14A shows a series of optical image 1512AO, topographic image 1512AT and line profile 1512AP for a sheet sample 1512A, with a surface defect 1512AD (scratch) in a background surface 1512AB after rolling with a 1200 μin (30 μm) Ra EDT roll at 850 F at 5% reduction in thickness. Prior to reduction rolling, the sheet sample had a background surface having a roughness Ra of 1 μm with a scratch having a depth of about 1000 μm, as shown in FIGS. 9C and 9D. As can be appreciated from FIG. 14A, the 5% reduction with the EDT texture roll, has reduced the perceptibility of the scratch 1512AD relative to that shown in FIGS. 9C and 9D. As demonstrated by the topographic image 1512AT and the line profile 1512AP, this reduction in visual perceptibility of the scratch 1512AD can be observed in the changes in surface dimensions, namely, average peak to valley difference, which is 65% less than in the sheet prior to rolling. Increasing the reduction to 10% in FIG. 14B and 20% in 14C decreases the scratch depth by 80% and 100% respectively.

Figure 15:
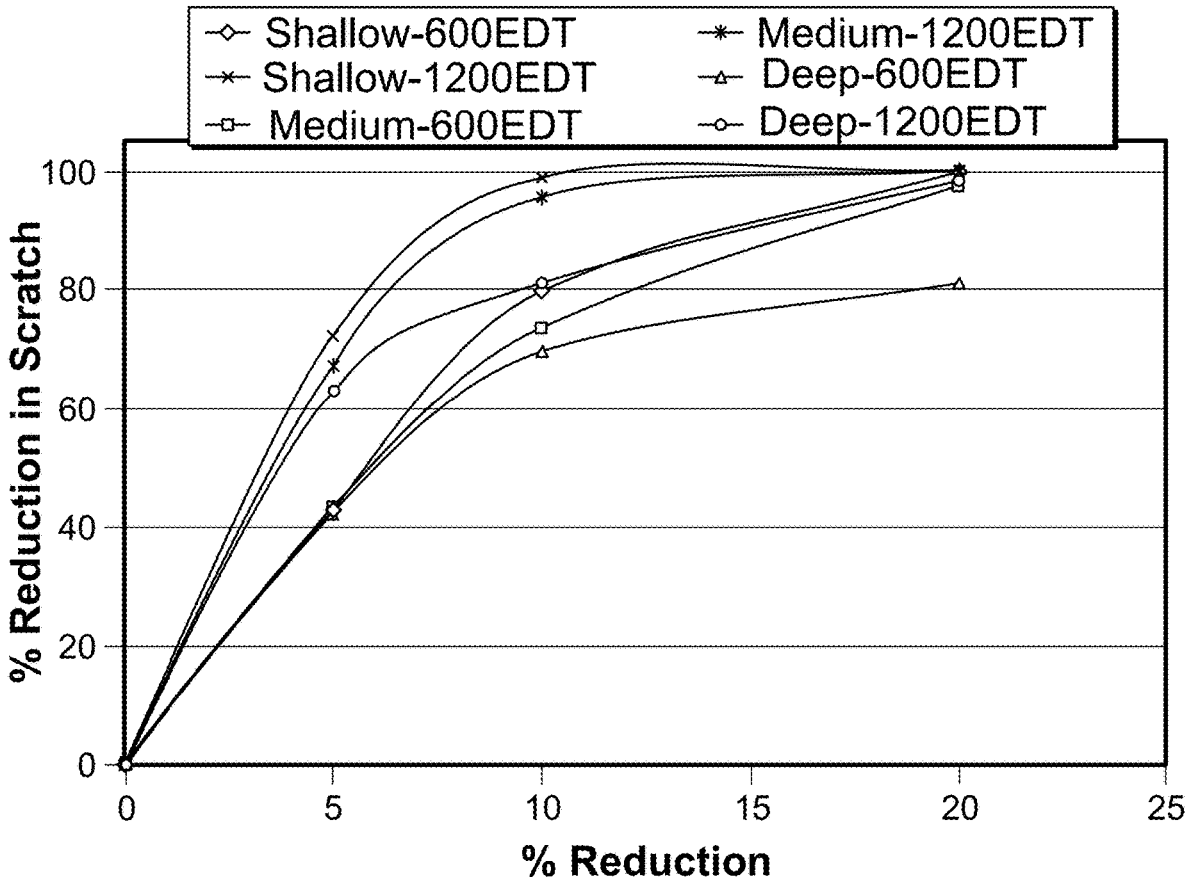
FIG. 15 is a graph showing percentage reduction in scratch depth for different scratch depths after rolling with EDT texture rolls.

FIG. 15 shows a graph of percentage reduction in scratch depth for shallow scratches (about 10 μm in depth and 200 μm in width) medium scratches (about 100 μm in depth and 500 μm in width) and for deep scratches (about 200 μm in depth and 1000 μm in width) after rolling with EDT texture rolls having a texture of either 600 EDT or 1200 EDT (600 μin Ra or 1200 μin Ra). The rolling apparatus used was like that depicted in FIG. 7 and the measurements for generating the graph of FIG. 15 were taken at state S27. State S27 is an intermediate state, i.e., after rolling by texture rolls 524A, 524B (which had an EDT texture of either 600 μin Ra or 1200 μin Ra), but prior to rolling with texture rolls 540A, 540B. It is noteworthy that the shallow and medium depth scratches were completely or almost completely obliterated by the 1200 EDT rolls at 10% reduction and that all other scratches were eliminated at 20% reduction with the exception of the deep scratch by the 600 EDT roll, which obliterated 80% of the scratch at 20% reduction.

Figure 16:
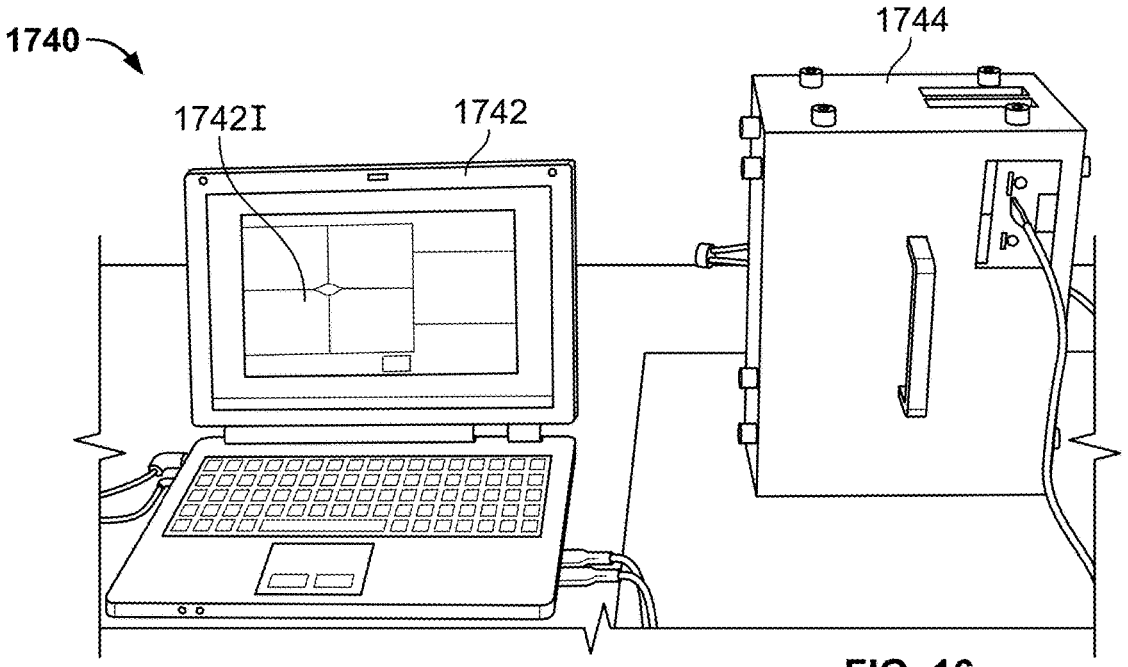
FIG. 16 is a photograph of a device for measuring light scatter from surfaces.
Figure 17A:
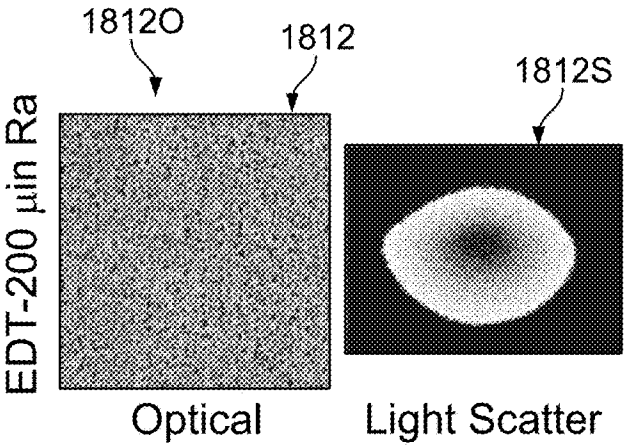
FIGS. 17A and 17B are each a series of optical image and light scatter signature for sample metal surfaces having an EDT finish and a mill finish, respectively, after 10% reduction

FIG. 16 shows a device 1740, utilizing a computer 1742 and a scanning device 1744 for measuring light scatter from a surface 1712. The computer 1742 displays an image 17421 modeling the light scatter of the surface 1712. The scanning device and computer software for programming the computer 1742 may be a ScatterScope obtained from The Scatter Works, Inc. of Tucson, Ariz., FIG. 17A shows an optical image 1812O of an aluminum sheet 1812 processed in accordance with the present disclosure, namely by the apparatus 10 shown in FIG. 1 with texturing rolls 20A, 20B having an EDT texture of 200 μin (5 μm) Ra at 10% reduction. A light scatter signature 1812S was taken from the surface of the sample 1812. FIG. 17B shows an optical image 1912O of an aluminum sheet 1912 with a normal mill finish at 10% reduction and a light scatter signature 1912S taken from the surface of the sample 1912. Light scatter 1812S shows an isotropic light scatter with light intensity in the X and Y directions being more uniform (approximating a more circular pattern) with the EDT roll versus a directional signature 1912S with the sheet 1912 having a normal mill finish.

Figure 17C:
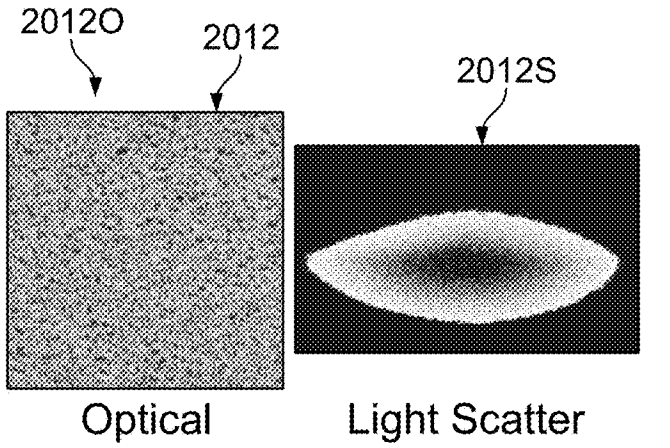
FIGS. 17C and 17D are each a series of optical image and light scatter signature for sample metal surfaces having an EDT finish and a mill finish, respectively, after 25% reduction.
Figure 17B:
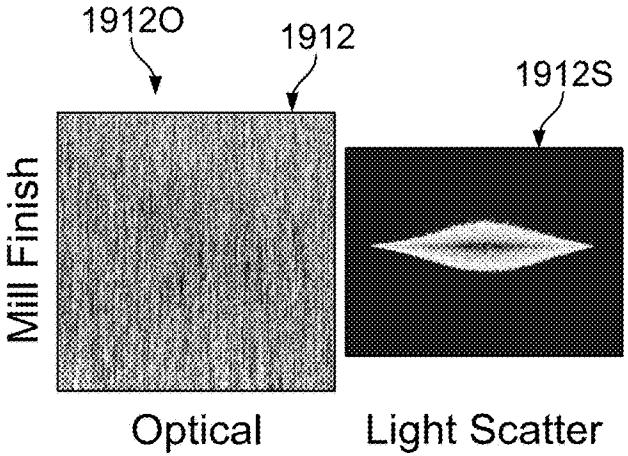
Figure 17D:
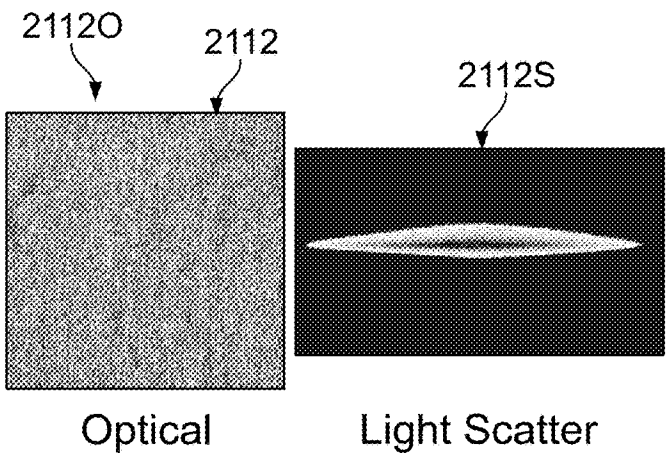

FIG. 17C shows an optical image 2012O of an aluminum sheet 2012 processed in accordance with the present disclosure, namely by the apparatus 10 shown in FIG. 1 with texturing rolls 20A, 20B having a mill finish having 200 μin (5 μm) Ra at 25% reduction. A light scatter signature 2012S is taken from the surface of the sample 2012. FIG. 17D shows an optical image 2112O of an aluminum sheet 2112 with a normal mill finish at 25% reduction and a light scatter signature 2112S taken from the surface of the sample 2112. Light scatter 2012S shows light intensity in the X and Y directions becoming more directional with the EDT roll compared to the light scatter 1812S of the sheet 1812 at 10% reduction, but still much less than the light scatter 2112S of the mill finish 2112 rolled at 25% reduction.

Figures 18A, 18B:
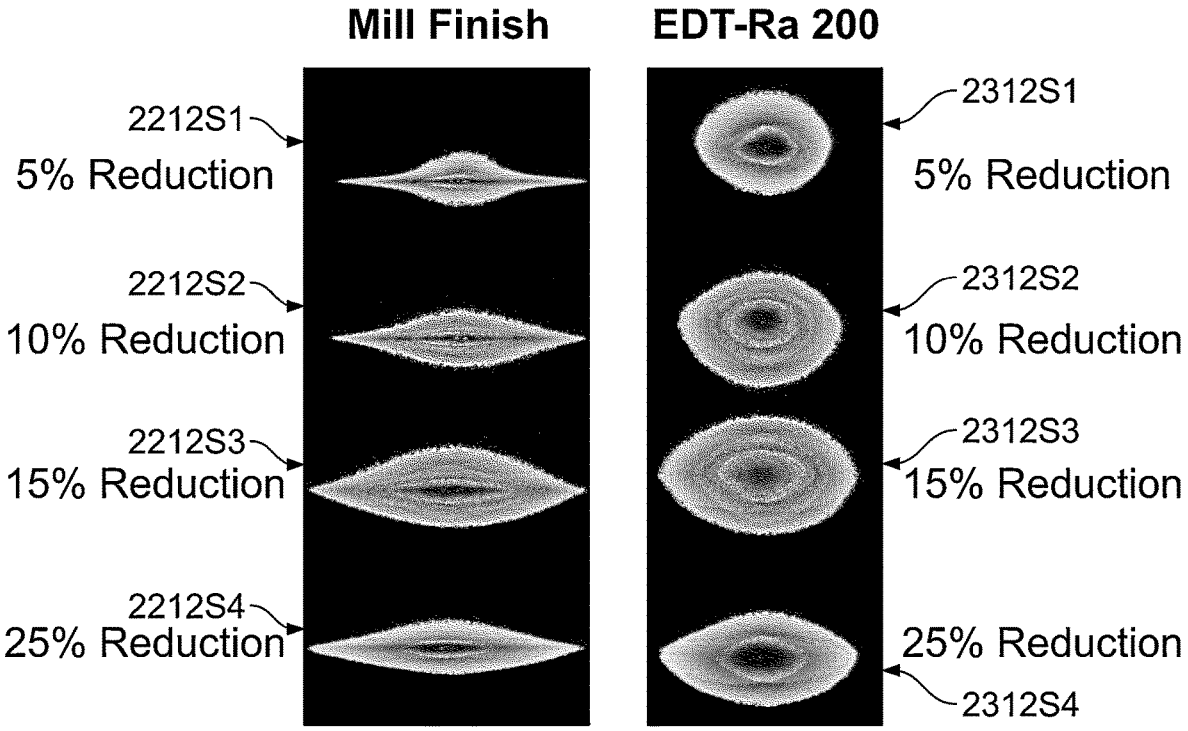
FIG. 18A is a series of light scatter signatures for a metal sample having a mill finish at 5%, 10%, 15% and 25% reductions
FIG. 18B is a series of light scatter signatures for a metal sample having an EDT finish at 5%, 10%, 15% and 25% reductions.

FIG. 18A shows a series of light scatter signatures 2212S1, 2212S2, 2212S3 and 2212S4 for an aluminum sheet metal sample having a mill finish impressed thereon by a 50 uin (1 um) Ra Mill finish roll at 5%, 10%, 15% and 25% reductions, respectively.

FIG. 18B shows a series of light scatter signatures 2312S1, 2312S2, 2312S3 and 2312S4 for an aluminum sheet metal sample having an EDT finish impressed therein by a 200 uin (5 um) Ra EDT roll at 5%, 10%, 15% and 25% reductions. Comparing the light scatter signatures of FIG. 19A to FIG. 19B leads to the conclusion that the EDT finish is less directional than the mill finish at all reductions.

Figures 19A, 19B:
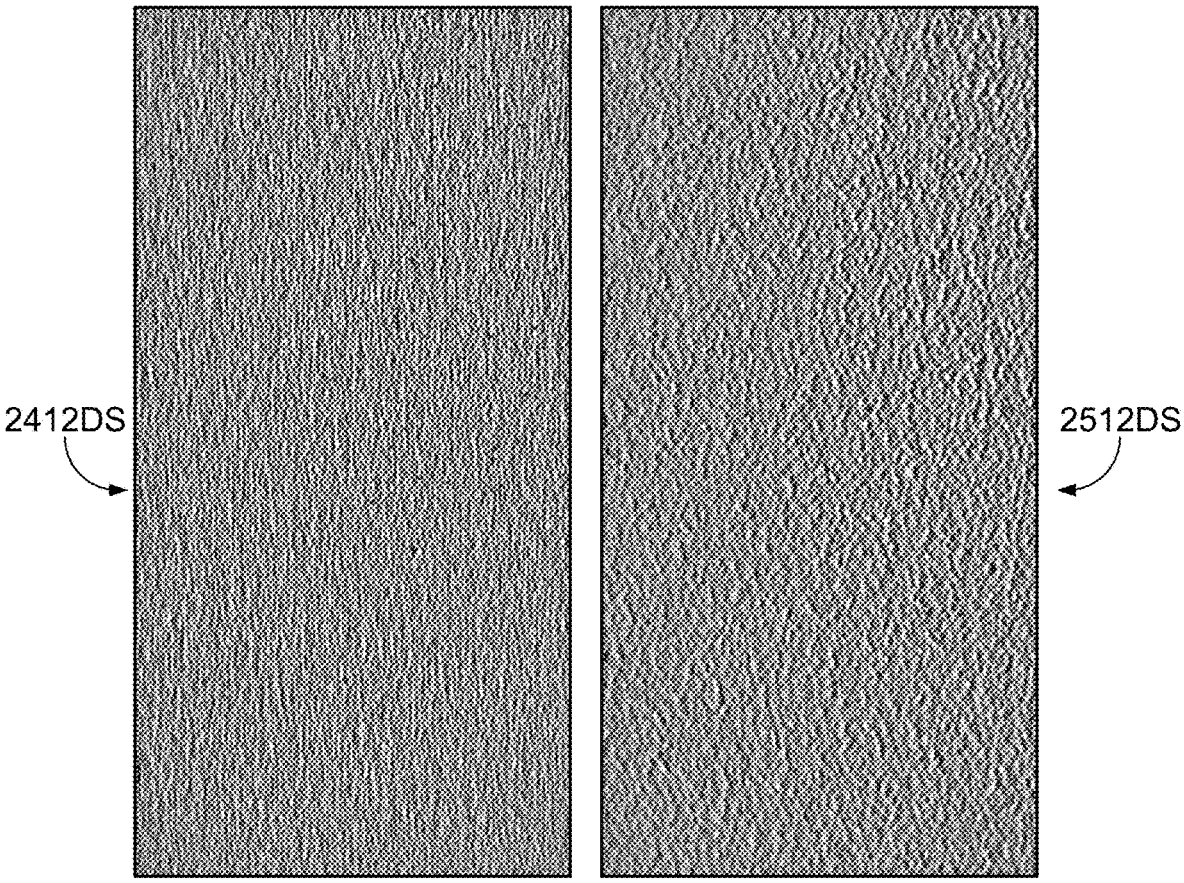
FIG. 19A shows a texture data signature of a mill finished surface and FIG. 19B is a texture data signature for an EDT textured surface.

FIG. 19A shows a texture data signature 2412DS of a mill finished surface obtained by an Optimap PSD device indicating the directional texture that may be quantified with this device and characteristic of the process used.

FIG. 19B shows a texture data signature 2512DS for an EDT textured surface obtained by an Optimap PSD device indicating less directionality that may also be quantified with this device and characteristic of the process used. The respective images shown in FIGS. 19A and 19B depict a surface area sample of about 95 mm×70 mm, illustrating that the non-directionality evident in the scatter signatures 2312S1-2312S4, which are derived from a circular test area of about 5 mm diameter, persist over large areas of the sheet and indicating that the entire sheet surface will exhibit non-directionality. The EDT roll texture eliminates non uniform surfaces coming into a rolling operation creating an isotropic surface signature measureable with optical or topography measurement systems such as an Optimap™ from Rhopoint Instruments, a Scatterscope from the Scatterworks or 3D interferometry or confocal microscopy. The surface signature is traceable through the textured and standard rolling processes and may be highlighted by surface coatings or treatments.

While the foregoing examples utilized high temperature, lowered yield strength, texture rolling at relatively low reductions, e.g., 0% to 30%, to remove surface imperfections, e.g., scratches, having dimensions, e.g., depth, in the range of 10 μm to 200 μm, greater reductions may be employed to remove more severe surface defects. For example, EDT rolls having a surface roughness Ra of 600 μin or 1200 μin may be used at reductions of up to 70% to remove scratches and other surface imperfections having a depth of 1 mm.

An aspect of the present disclosure is utilizing the above-described techniques to produce metal sheet that may be suitable for use in forming body panels for automobiles. In one embodiment, the metal sheet produced by an embodiment of the present disclosure is used to form closure panels, e.g., those metal panels that are coupled together to form a door or hood structure for an automobile. In another embodiment, the metal sheet produced by the methods of the present disclosure may be used to form at least part of a body-in-white, a term used to describe a car body sheet metal assembly prior to painting or the installation of glass, trim and moving parts, such as suspension and drivetrain components.

It should be understood that the embodiments described herein are merely exemplary and that a person skilled in the art may make many variations and modifications without departing from the spirit and scope of the claimed subject matter. For example, the texture rolling temperature and reduction may be adjusted to accommodate different aluminum alloys. All such variations and modifications are intended to be included within the scope of the present disclosure and claims.

We claim:

1. A method for rolling an aluminum alloy metal sheet provided at a first state to achieve a second state, comprising:

rolling the aluminum alloy metal sheet with an EDT texture roll when the aluminum alloy metal sheet is at a temperature between 250 to 970 degrees Fahrenheit, wherein the rolling comprises contacting a bare surface of the aluminium alloy metal sheet with the EDT texture roll, wherein the rolling comprises imparting an EDT texture to a surface of the aluminum alloy metal sheet to achieve the second state; and wherein, in the second state, the bare surface of the aluminum alloy metal sheet comprises a background surface roughness, and wherein the aluminum alloy metal sheet is free of surface defects that are more than 2 micrometers Ra different than the background surface roughness.

2. The method of claim 1, wherein the EDT texture roll comprises a surface roughness Ra in the range of from 1 micrometer to 50 micrometers.

3. The method of claim 2, wherein the rolling comprises reducing a thickness of the aluminum alloy metal sheet by from 0% to 30%.

4. The method of claim 3, wherein the rolling results in a transfer of texture to between 60% to 100% of the surface of the aluminum alloy metal sheet.

5. The method of claim 2, wherein the rolling comprises reducing a thickness of the aluminum alloy metal sheet by from 0% and 70%.

6. The method of claim 1, wherein the rolling is a first rolling step, and wherein the method comprises completing a second rolling step on the aluminum alloy metal sheet and subsequent to the first rolling step.

7. The method of claim 6, wherein the second rolling step is a second texture rolling step.

8. The method of claim 7, wherein the EDT texture roll is a first EDT texture roll, wherein the second rolling step comprises using a second EDT texture roll, and wherein the first EDT texture roll has a coarser texture than the second EDT texture roll.

9. The method of claim 8, wherein the first rolling step and the second rolling steps decrease a grain size of the aluminum alloy metal sheet.

10. The method of claim 6, wherein the second rolling step comprises cold rolling.

11. The method of claim 6, wherein the second rolling step comprises hot rolling.

12. The method of claim 6, wherein the first rolling step comprises creating lubricant retaining surface features in the aluminum alloy metal sheet, wherein the lubricant retaining surface features are capable of receiving lubricant therein.

13. The method of claim 6, wherein the first rolling step remediates surface defects present in the aluminum alloy metal sheet that would not otherwise be remediated by the second rolling step.

14. The method of claim 1, wherein rolling comprises redistributing metal in the aluminum alloy metal sheet through deformation.

15. The method of claim 1, wherein the rolling is a final rolling step prior to winding the aluminum alloy metal sheet into a coil.

16. The method of claim 1, wherein, prior to the rolling, the bare surface of comprises surface defects, and wherein the surface defects have a size of from 10 micrometers to 1 millimeter.

17. The method of claim 15, wherein the rolling is accompanied by at least one of once-through lubrication, evaporative roll cooling, roll surface coating or high-pressure water blasting.

18. The method of claim 1, wherein, prior to the rolling, the temperature of the aluminum alloy metal sheet is from 250 to 970 degrees Fahrenheit, and wherein the temperature is attributable to residual heat present in the aluminum alloy metal sheet persisting from a prior state of processing.

19. The method of claim 1, comprising, prior to the rolling, heating the aluminum alloy metal sheet to a temperature of from 250 to 970 degrees Fahrenheit by a source of heat.

20. The method of claim 1, wherein a texture of the EDT texture roll is at least partially conferred to the EDT texture roll by at least one of ball peening, shot peening, grinding or cross-grinding.

21. The method of claim 1, further comprising, after the rolling, forming the aluminum alloy metal sheet into an automotive panel.

22. The method of claim 21, wherein the automotive panel is a closure panel.

23. The method of claim 22 wherein forming comprising joining the closure panel and to another closure panel.

24. The method of claim 21, further including incorporating the automotive panel in a body-in-white component automobile.

25. The method of claim 1, wherein the aluminum alloy metal sheet is provided in the first state by a continuous aluminum alloy casting process.

26. The method of claim 16, wherein the texture of the EDT texture roll is within the range of 600 to 1200 micro-inches, and wherein the rolling comprises reducing a thickness of the aluminum alloy metal sheet by from 5% to 25%.

27. The method of claim 16, wherein the surface defects are at least one of scratches or slivers.

28. The method of claim 16, wherein the surface defects form a visually discernable pattern as perceived by the unaided human eye.

29. The method of claim 28 wherein the discernable pattern is a repeating pattern.

30. The method of claim 16, wherein the surface defects are obscured by reducing the average peak to valley distance of bare surfaces of the aluminum alloy metal sheet.

* * * * *